US007137387B2

(12) United States Patent
Edwards et al.

(10) Patent No.: US 7,137,387 B2
(45) Date of Patent: Nov. 21, 2006

(54) OVEN LOCK WITH MECHANICAL ACTUATION OF REMOTELY LOCATED DOOR SWITCH

(75) Inventors: Charles V. Edwards, Columbus, IN (US); Harry I Courter, Indianapolis, IN (US); Tracy J. Talley, Indianapolis, IN (US)

(73) Assignee: Emerson Electric Co., St. Louis, MO (US)

( * ) Notice: Subject to any disclaimer, the term of this patent is extended or adjusted under 35 U.S.C. 154(b) by 76 days.

(21) Appl. No.: 10/877,145

(22) Filed: Jun. 25, 2004

(65) Prior Publication Data

US 2005/0284464 A1 Dec. 29, 2005

(51) Int. Cl.
*F24C 15/04* (2006.01)

(52) U.S. Cl. ..... 126/190; 126/191; 126/192; 126/197; 292/110; 292/11; 292/129; 292/201; 292/229; 292/341

(58) Field of Classification Search ..... 126/191, 126/192, 197, 190; 292/110, DIG. 69, 111, 292/129, 201, 229, 341
See application file for complete search history.

(56) References Cited

U.S. PATENT DOCUMENTS

| | | | | |
|---|---|---|---|---|
| 3,462,584 | A * | 8/1969 | Guy | 219/412 |
| 3,569,670 | A | 3/1971 | Eff | |
| 3,859,979 | A | 1/1975 | Gilliom | |
| 3,875,372 | A * | 4/1975 | Gilliom | 219/413 |
| 3,912,904 | A * | 10/1975 | Phifer | 219/413 |
| 4,109,637 | A | 8/1978 | Drouin | |
| 4,374,320 | A | 2/1983 | Barnett | |
| 4,927,996 | A | 5/1990 | Genbauffe et al. | |
| 6,302,098 | B1 | 10/2001 | Smith | |

* cited by examiner

*Primary Examiner*—Carl D. Price
(74) *Attorney, Agent, or Firm*—Maginot Moore and Beck

(57) ABSTRACT

An oven lock mechanism is disclosed having a latch mechanism driven by a motor between a latched position wherein the oven door is held in a closed position and an unlatched position wherein the oven door freely opens and closes. The motor is controlled by a switch that enables rotation of the motor when in a first state and prevents rotation of the motor when in a second state. A switch actuator mechanism places the switch in the first state when the door is closed and in the second state when the door is open. The switch is mounted at the rear of the oven away from the front opening of the oven compartment.

20 Claims, 17 Drawing Sheets

OVEN LOCK WITH MECHANICAL ACTUATION OF REMOTELY LOCATED DOOR SWITCH

CROSS REFERENCE

Cross reference is made to co-pending U.S. patent application Ser. No. 10/877,151, entitled Motorized Oven Door Lock with Pull-In Capabilities by Harry I. Courter, Matthew L. Kemp and Tracy J. Talley, which is assigned to the same assignee as the present invention, and which is filed concurrently herewith, the disclosure of which is hereby totally incorporated by reference in its entirety.

BACKGROUND AND SUMMARY

This invention relates generally to self-cleaning oven door locks and more particularly to door locks wherein the act of closing the oven door actuates a switch the actuator of which is centrally located relative to the front of the oven frame.

The walls of the cooking chamber of conventional gas or electric ovens collect deposits from items cooked in the oven. Modern self-cleaning ovens reduce these deposits to dust with high heat when a self-cleaning cycle is initiated by a user. This cleaning method is commonly known as pyrolytic cleaning. The high temperature used for pyrolytic cleaning poses a hazard if the oven door is opened during the cleaning cycle. To prevent this, an oven door lock is employed.

Many types of oven door locks have been provided that lock the oven door for a period sufficient to complete a pyrolytic cleaning cycle. Typically, such ovens include a switch actuated by closure of the oven door that energizes or enables a driver circuit for locking the oven door. Many of these door locks use electrical motors, electromechanical machines or manual manipulation of mechanisms to move a latch to a position in which the latch prevents the oven door from being opened during a self-cleaning cycle. Examples of such locks are disclosed in Eff, U.S. Pat. No. 3,569,670; Gilliom, U.S. Pat. No. 3,859,979; Drouin, U.S. Pat. No. 4,109,637; Barnett, U.S. Pat. No. 4,374,320; Genbauffe et al., U.S. Pat. No. 4,927,996 and Smith, U.S. Pat. No. 6,302,098.

Smith, U.S. Pat. No. 6,302,098 discloses an oven door latch assembly with a motor and a switch located in a rearward position and a latch mounted for pivotal and longitudinal movement between an unlatched position, a latched position and a latched and sealed or pulled-in position. Smith uses a bias spring to bias the latch toward the unlatched position. The unnumbered switch in Smith does not appear to be a switch that actuates the motor drive circuitry but rather appears to be a switch that is actuated by a cam driven by the motor. Such switches tend to provide a change of state signal to a pyrolytic oven controller indicating that the oven is currently locked.

Ovens using latching mechanisms similar to that disclosed in Smith typically include a switch that actuates the drive circuitry for the motor so that it can move the latch into the latched position only when door is closed. Thus, upon receipt of a request to initiate a cleaning cycle, the motor can rotate the latch to seal and lock the oven. Some such ovens use a switch mounted near the front of the oven with a plunger extending forwardly beyond the frame so that it can be depressed by the door during closure to actuate the drive circuitry. Such switches must be heat tolerant. Other such ovens use a switch mounted at the rear of the oven that is actuated by engagement of the door with a switch actuator extending between the switch and the front of the oven to enable the motor of the oven latch mechanism. The switch actuator in these ovens is typically mounted near the side of the oven frame to be engaged by the side of the oven door upon door closure.

Through use doors may become warped or bent so that sides of the oven doors do not engage the sides of the frames unless the oven door is pulled-in. A switch actuated by the side of the oven door during closure might not be actuated by a warped or bent oven door. The failure of the oven door to actuate a switch enabling the motor of the lock mechanism can result in a service call on the self-cleaning oven as the self-cleaning function may not implement on demand.

The disclosed oven lock mechanisms position an actuator for a switch enabling the motor driving circuit in the center of the front frame of the oven so that the actuator is engaged by the center of the oven door upon closure. Thus door warpage is not as likely to disable the self-cleaning feature of the oven. In the illustrated embodiments, the switches enabling the motor drive circuit of the oven cleaning mechanism are located at the rear of the oven away from the high temperatures present adjacent the oven compartment opening.

According to one aspect of the disclosure, an oven locking mechanism for a self-cleaning oven is provided. The oven includes an oven compartment having an opening defined by a top frame wall, a bottom frame wall and side frame walls. The oven includes an oven door having a top wall, a bottom wall and side walls configured to close the oven compartment. The top walls of the oven frame and the oven door have a central region displaced from the side walls. The oven locking mechanism comprises a latch, an electromechanical actuator, a switch, a plunger and a switch actuator. The latch is mounted to extend forwardly beyond the central region of the top wall of the oven frame to engage a portion of the door located in the central region when moved into a latched position. The electromechanical actuator is coupled to the latch for moving the latch to the latched position when actuated. The switch is electrically coupled to the electromechanical actuator and configured to enable the electromechanical actuator when in a first state and disable the electromechanical actuator when in a second state. The switch is mounted to the oven away from the opening. The plunger is mounted in the central region of the top wall of the frame for movement relative to the frame. The plunger has a door engaging end which when the plunger is in a first position extends forward beyond the frame of the oven in a position to be engaged by a portion of the door in the central region of the top wall during closure of the oven door. The switch actuator is configured to change the state of the switch between the first and second states based on the position of the plunger.

In another aspect of the disclosed device, an oven lock mechanism is provided for a self-cleaning oven having a front, a rear and a front opening oven compartment and an oven door configured to close the oven compartment. The lock mechanism comprises a latch mechanism, a switch and a switch actuator mechanism. The latch mechanism latches the door by engaging a portion of the door. The latch mechanism includes a latch, an electromechanical actuator, and drive circuitry. The latch is mounted for movement relative to the oven frame between a first position in which the oven door opens and closes freely without being inhibited by the latch and a second position in which the latch inhibits opening a closed oven door. The electromechanical actuator is coupled to the latch for moving the latch between the first and the second positions. The drive circuitry is configured to selectively drive the electromechanical actuator. The switch is electrically coupled to the drive circuitry and configured to enable the drive circuitry when in a first state and disable the drive circuitry when in a second state. The switch is mounted to the oven at the rear of the oven. The switch actuator mechanism includes a plunger and a switch actuator. The plunger is mounted to the front of the oven for movement relative to the oven. The plunger has a door engaging end which when the plunger is in a first position extends forward beyond the frame of the oven in a position to be engaged by a portion of the oven door during closure of the oven door. The switch actuator mechanism is configured to change the state of the switch between the first and second states based on the position of the switch plunger. The plunger and latch are mounted to engage a portion of the door not seriously affected by door warpage or bending.

According to yet another aspect of the disclosed device, an oven lock mechanism is provided for an oven having a front opening oven compartment having a back wall and side walls, a top frame wall disposed above the oven compartment and having a central portion displaced from the side walls and a door configured to close the oven compartment by pivoting from an open to a closed position. The lock mechanism comprises front and rear mounting plate portions, a latch, a motor, a switch and a switch actuating mechanism. The front mounting plate portion is mounted to the center portion of the top frame wall. The rear mounting plate portion is mounted to the back wall of the oven compartment. The latch is pivotally mounted to the front mounting plate portion. The latch comprises a latch hook extending forwardly beyond the top frame wall. The latch is configured to pivot between a latched position wherein the latch hook engages and inhibits pivotal movement of the door and an unlatched position wherein the latch does not inhibit pivotal movement of the door. The motor is coupled to the latch to move the same between the latched and unlatched positions when driven. The switch is configured to enable the motor to be driven when in a first state and disable the motor from being driven when in a second state. The switch is mounted to the rear mounting plate portion. The switch actuating mechanism includes an engagement portion and an actuator portion. The engagement portion is mounted for movement relative to the front mounting plate portion and configured to engage and be moved by the door during pivotal movement of the door. The actuator portion is coupled to the engagement portion and configured to change the state of the switch from the second state to the first state in response to movement of the engagement portion.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

DETAILED DESCRIPTION OF THE DRAWINGS

Figure 1:
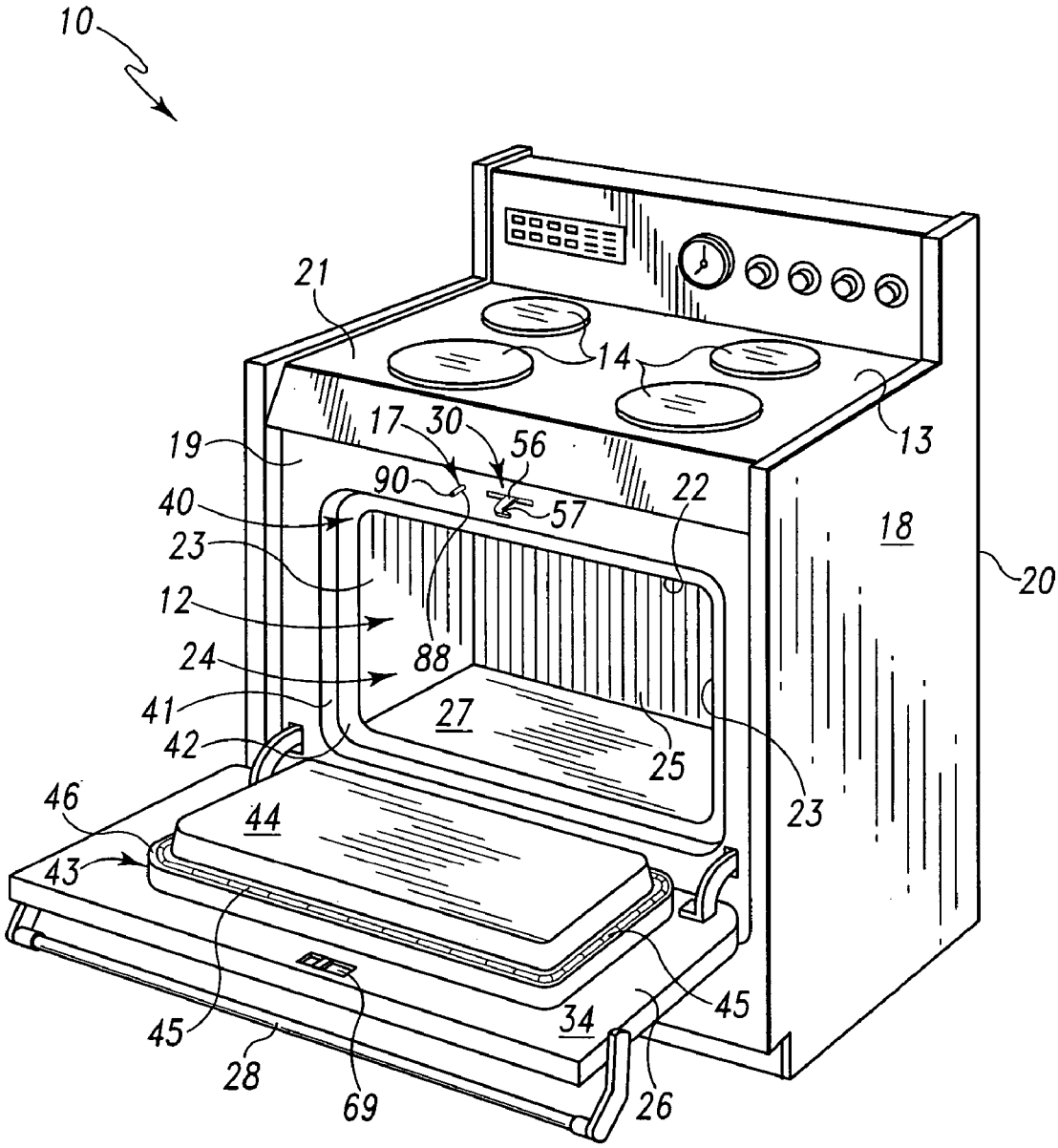
FIG. 1 is a perspective view of a range including a self-cleaning oven and incorporating an oven lock mechanism in accordance with the present disclosure mounted so that the hook of the latch mechanism and the end of a rod acting as a switch actuator mechanism extend forwardly beyond the center of the frame of the oven to interact with the oven door upon closure thereof.
Figure 2:
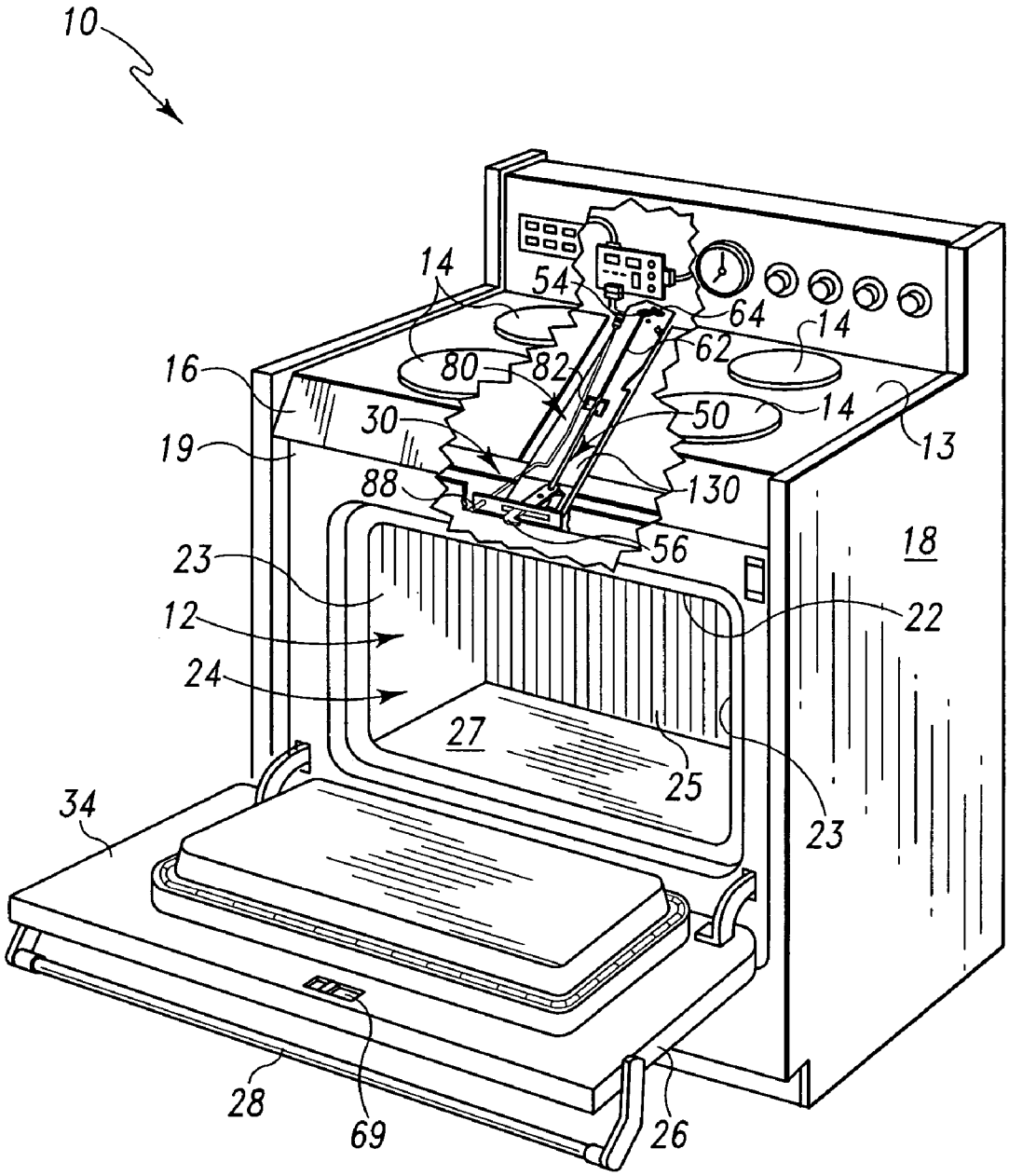
FIG. 2 is a perspective view with parts broken away of the range of FIG. 1 showing a first embodiment of an oven lock mechanism mounted above the center of the oven compartment and below the cook top, FIG. 2 also accurately depicts a second embodiment of an oven lock mechanism.
Figure 3:
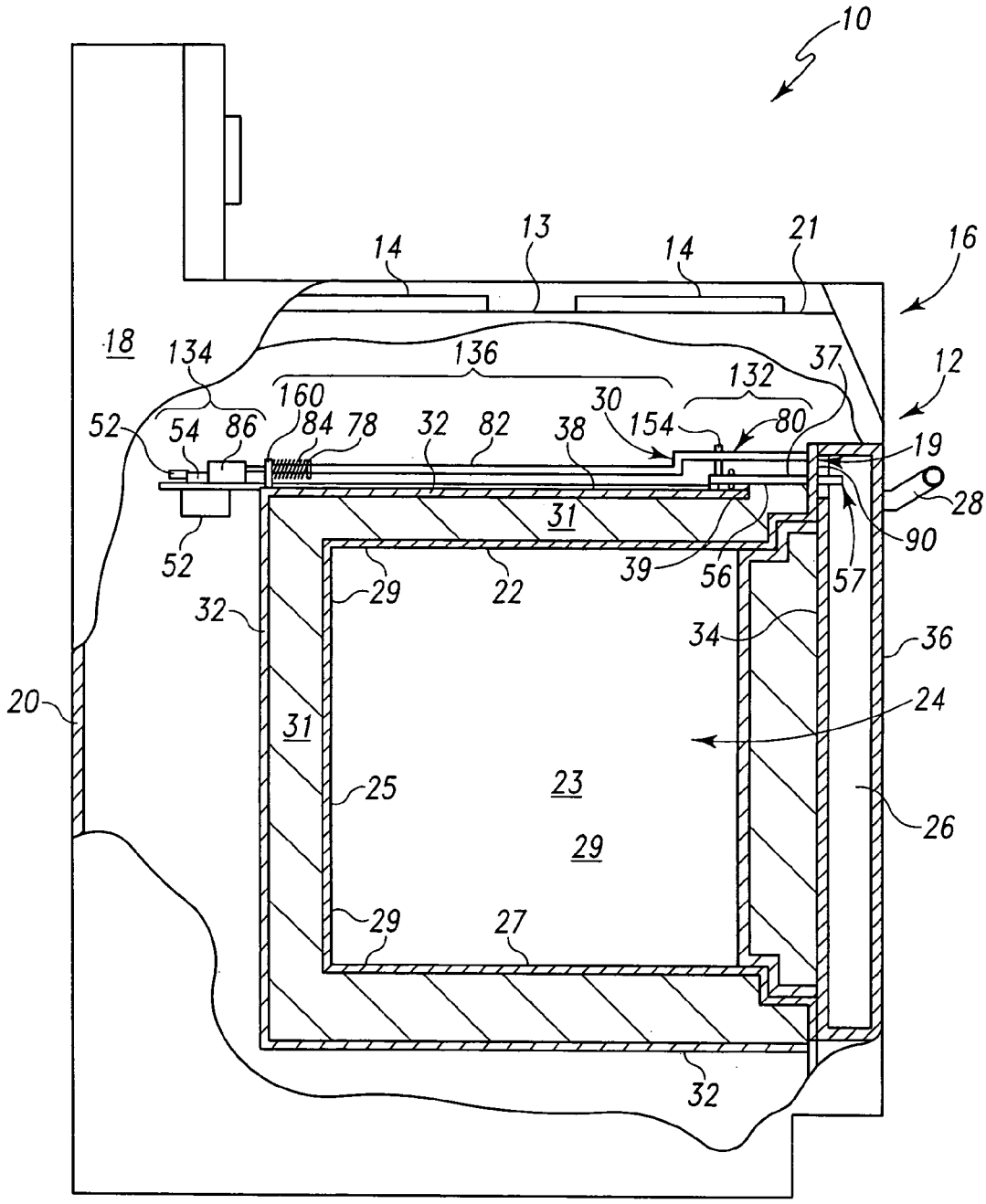
FIG. 3 is a side elevation view with parts broken away of the oven lock mechanism of FIG. 2.

As shown, for example, in FIG. 1, the oven lock mechanism 30 disclosed herein positions a portion of an actuator 80 for a switch 86 in a position to be engaged by the center of the top of the oven door 26 upon closure of the oven door 26. In the illustrated embodiment, a latch 56 is mounted for pivoting between a latched position and an unlatched position. In the unlatched position movement of the oven door 26 between an open and a closed position is not inhibited. In the latched position, movement of the oven door 26 from the closed position to an opened position is inhibited by engagement of a component of the center of the door 26 by the latch 56. FIGS. 1–3 show the position of the latch 56 and the actuator with respect to the front frame wall 19 of the oven 12 as they would be positioned if the first or second embodiment of the oven lock mechanism 30, 230 was mounted to the oven 12. If the third or fourth embodiment of the oven lock mechanism 430, 630 was mounted to the oven 12, the opening of the latch hook 457 would be facing the other direction from the direction shown in FIG. 1. Since each of the illustrated embodiments disclose an oven lock mechanism 30, 230, 430, 630 having the components that interact with the door 26 located centrally with respect to the oven door 26, such embodiments are not as susceptible to failure, as a result of door warpage or bending, as known oven lock mechanisms.

As shown, for example, in FIGS. 2–10, 13 and 15–22, a motor 52 mounted at the rear of the oven 12 rotates a cam 54 that is coupled by a rod 62, 462 to the latch 56, 456. The latch 56, 456 is mounted for pivotal movement relative to the frame of the oven 12. The motor driver circuit (not shown) is enabled and disabled by the switch 86, 486, 686 actuated by the centrally mounted actuator 80, 280, 480, 680. This motor-enabling switch 86, 486, 686 is also mounted at the rear of the oven 12. Thus, in each of the illustrated embodiments of the oven lock mechanism 30, 230, 430, 630 the temperature sensitive motor 52 and switches 86, 486, 686, 64 are located at the rear of the oven 12 away from the high temperature region adjacent to the opening of the oven compartment 24. As the heat tolerance of a motor or switch increases, the cost of the switch or motor increases. Motors and switches capable of tolerating the temperatures commonly present at the rear of an oven during the self-cleaning cycle are substantially cheaper than motors and switches capable of tolerating the temperatures experienced at the front of the oven 12 adjacent the oven opening. Thus, each of the illustrated embodiments 30, 230, 430, 630 facilitates using lower cost components for implementing the locking mechanism.

The illustrated embodiments of the oven lock mechanism 30, 230, 430, 630 move all of the more heat sensitive components utilized in an oven lock mechanism to the back of the oven 12 away from the high heat often experienced at the front of the oven 12 near the interface of the door 26 and the abutment surface of the front wall 19 of the frame. In each embodiment, long rods or linkages couple the latch 56 to a cam 54 driven by the motor 52. Rods or linkages also couple the actuator 80, 280, 480, 680 to the motor-enabling switch 86, 486, 686. In the first and second embodiments of the oven lock mechanism 30, 230, the actuators are spring biased rods 82, 282 reciprocally mounted to a mounting plate 130, 330 and configured to actuate the motor-enabling switch 86 when reciprocated rearwardly with respect to the mounting plate 130. In the first and second embodiments, the rod 82, 282 is bent to form a switch contact surface on a laterally extending C-shaped bend 118 in the switch actuator portion 114 of actuator rod 82, 282 for selective engagement of the switch contact 126. In the third embodiment 430, a lever 514 mounted to pivot between a switch closed position and a switch opened position acts along with rod 482 coupled to a spring biased actuator plunger 488 to actuate the motor-enabling switch 486. A fourth embodiment 630 replaces the lever 514 of the third embodiment with a slide mechanism 714 that actuates the motor-enabling switch 686. In each illustrated embodiment, a portion of the latch 56, 456 and a portion of the switch actuator 88, 488, are located in the high temperature region at the front of the oven 12 to be able to interact with the oven door 26.

The motor and gear box (hereinafter referred to as motor 52), cam 54 and rod 62, 462 for converting rotational movement of the motor 52 to reciprocal movement of the rod 62, 462, is the same in each illustrated embodiment of the oven lock mechanism 30, 230, 430, 630. However, the configuration, method of mounting and manner of operation of the latch 56, 456 differ between the first and second embodiments 30, 230 and the third and fourth embodiments 430, 630. The first and second embodiments 30, 430 provide a latch 56 that pivots between latched and unlatched positions and when in the latched position can translate rearwardly to pull-in the oven door 26. The third and fourth embodiments 430, 630 provide a latch 456 that only pivots between unlatched and latched position and can be made to pivot farther into a latched and pulled-in position.

It is within the scope of the disclosure to use the latch mechanism 50 of the first and second embodiments 30, 230 with motor-enabling switch mechanisms 480, 680 of the third and fourth embodiments 430, 630. Likewise, it is within the scope of the disclosure to use the latch mechanism 450 of the third and fourth embodiments 430, 630 with motor-enabling switch mechanisms 80, 280 of the first and second embodiments 30, 230. It is also within the scope of the disclosure for the switch actuator mechanisms 80, 280, 480, 680 disclosed herein to be used in combination with other oven door latch mechanisms. It is within the scope of the disclosure to use other oven latch mechanisms that position an electro-mechanical latch actuator at the rear of the oven with one of the disclosed switch actuator mechanisms 80, 280, 480, 680 so most of the benefits of the illustrated oven latch mechanisms can be realized. The latch mechanism 50 described herein is more fully described in commonly assigned co-pending U.S. patent application Ser. No. 10/877,151, entitled Motorized Oven Door Lock with Pull-In Capabilities by Harry I. Courter, Matthew L. Kemp and Tracy J. Talley, the disclosure of which is hereby expressly incorporated herein by this reference. While not realizing all of the benefits that can be realized from the illustrated oven lock mechanisms, it is within the scope of the disclosure to use a disclosed switch actuator mechanism 80, 280, 480, 680 with an oven latch mechanism that mounts the motor or another electro-mechanical latch actuator in or near the high temperature region adjacent the front opening of the oven.

As shown, for example, in FIGS. 1–3 and 15–16, a self-standing range 10 includes a pyrolytic self-cleaning oven 12 on top of which is a cook top 13 including a plurality of burners 14. The range 10 includes a body 16 having a pair of side walls 18, a front wall 19, a back wall 20 and a top 21. Spaced a fixed distance below the top 21 of the range body 16 is an oven top wall 22. An oven cavity 24 is defined by the oven cavity top wall 22, oven cavity side walls 23, an oven cavity back wall 25 and an oven cavity bottom wall 27. Illustratively, each cavity wall 22, 23, 25, 27 includes an inner metallic wall 29, an insulation layer 31 and an outer metallic wall 32, as shown for example, in FIGS. 3, 16. While not shown, one or more heating elements are typically located within the oven cavity 24.

Figure 15:
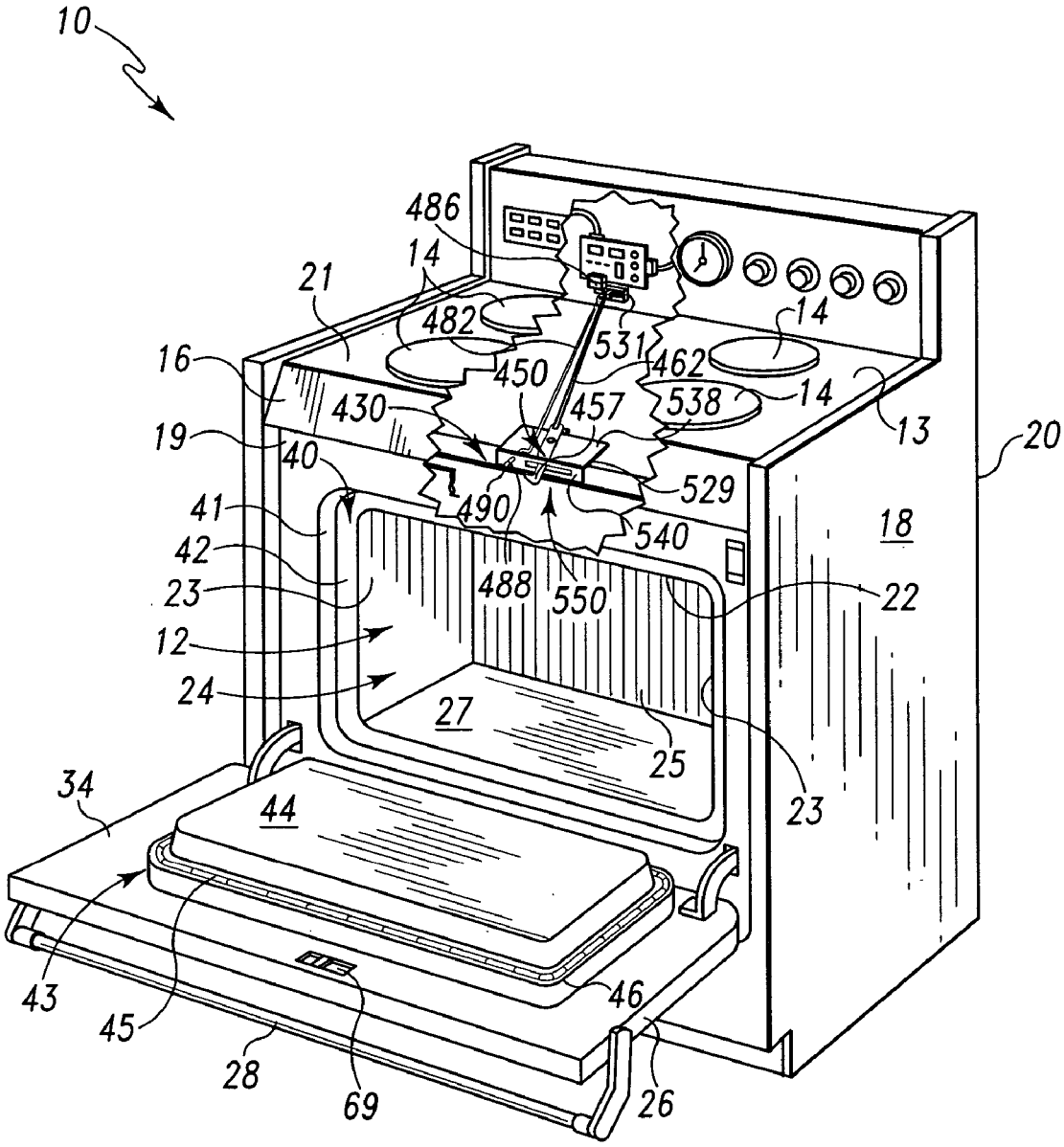
FIG. 15 is a perspective view with parts broken away of the range of FIG. 1 showing a third embodiment of an oven lock mechanism mounted above the center of the oven compartment and below the cook top, FIG. 15 also accurately depicts a fourth embodiment of an oven lock mechanism.

An oven door 26 having a handle 28 is hingedly mounted at its bottom to the front wall 19 of the range body 16 below the front opening of the oven cavity 24. The oven door 26 opens about a horizontal axis to move between an open position as shown in FIGS. 1, 2, 15 and a closed position as shown in FIG. 3, 16. The oven door 26 includes a back wall 34 and a front wall 36 spaced apart from the back wall 34. The area between the front wall 36 and the back wall 34 is often filled with insulation in regions covering the oven opening and left as a void in other regions. While not shown, oven door 26 includes a plurality of spring assemblies, which as the oven door 26 approaches the closed position tend to urge the oven door 26 closed.

In the illustrated embodiment, the front wall 19 of the frame of the oven 12 is formed to include a recessed region 40 surrounding the front opening of the oven cavity 24. Recessed region 40 includes a rearwardly extending side wall 41 and a forwardly facing wall 42 surrounding the oven cavity 24. The back wall 34 of the oven door 26 includes a similarly configured protrusion 43. A plug portion 44 of the protrusion 43 extends into the oven cavity 24 slightly when the oven door 26 is closed, as shown for example, in FIG. 3. A seal or gasket 45 is mounted on a peripheral wall 46 surrounding the plug portion 44 of the protrusion 43, as shown, in FIGS. 1 and 2. When the oven door 26 is closed, the seal 45 engages the forwardly facing wall 42 of the recessed region 40 of the oven frame. When the oven door 26 is locked during a self cleaning cycle, the first and second embodiments of oven door lock mechanism 30, 230 compress the seal 45 between the forwardly facing wall 42 of the recessed region 40 and the peripheral wall 46 surrounding the plug portion 44 of the protrusion 43, as shown, for example, in FIG. 3.

Figure 4:
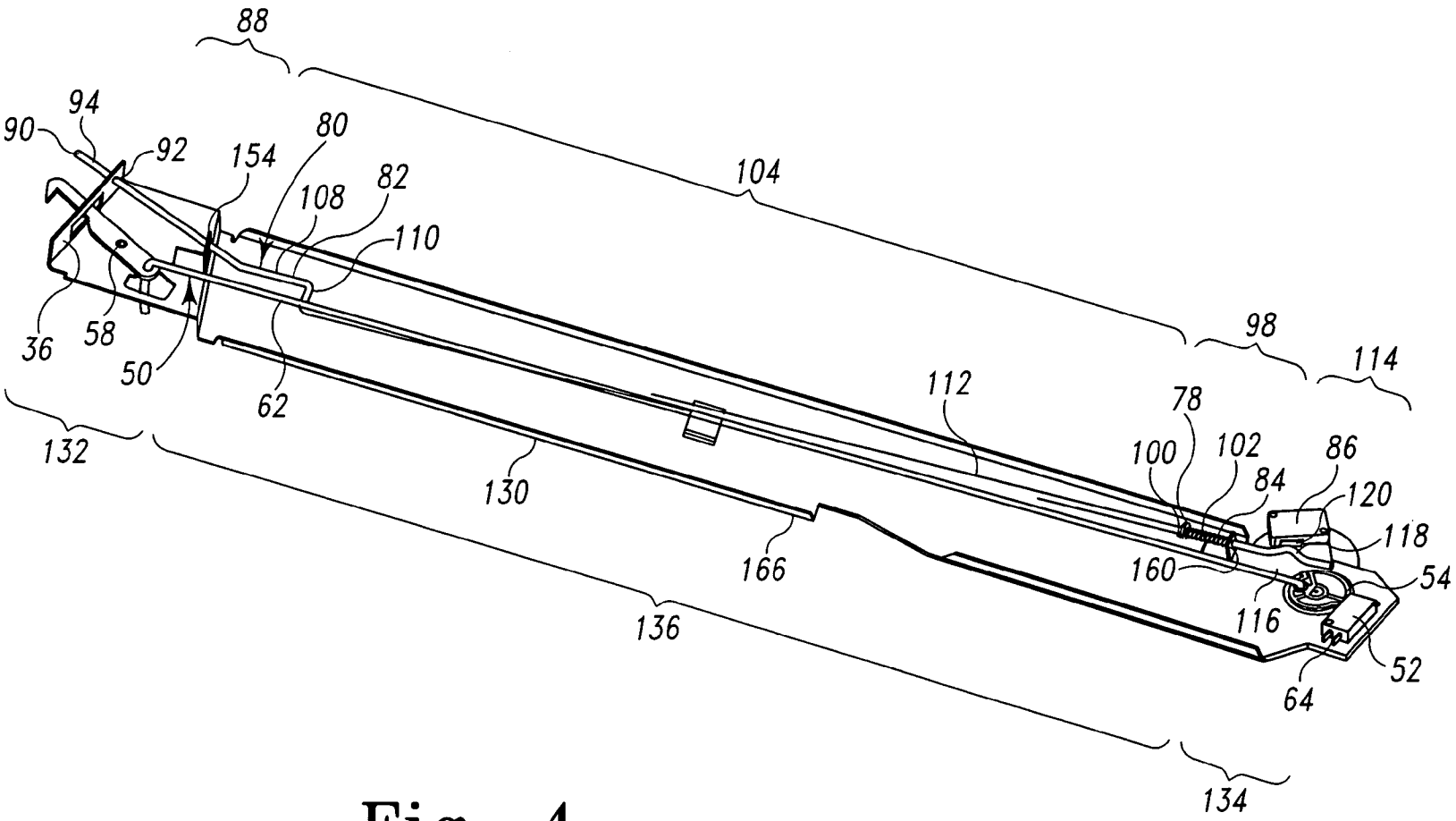
FIG. 4 is a perspective view of the first embodiment of the oven lock mechanism of FIG. 2 showing a mounting plate to which a latch mechanism and a switch actuator mechanism are mounted.
Figure 5:
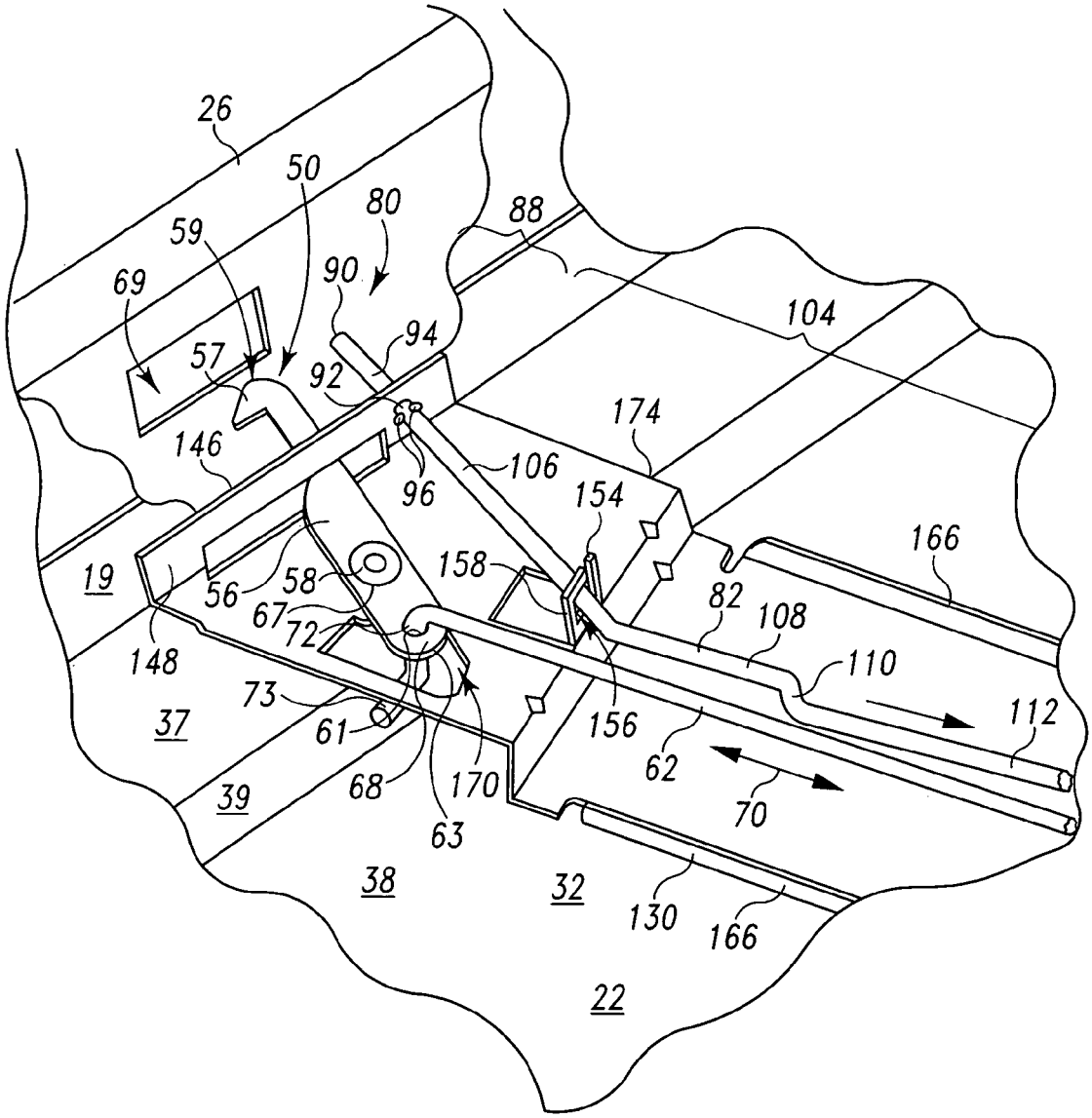
FIG. 5 is a perspective view with parts broken away of the front portion of the oven and oven lock mechanism of FIG. 2 in an unlatched position.
Figure 6:
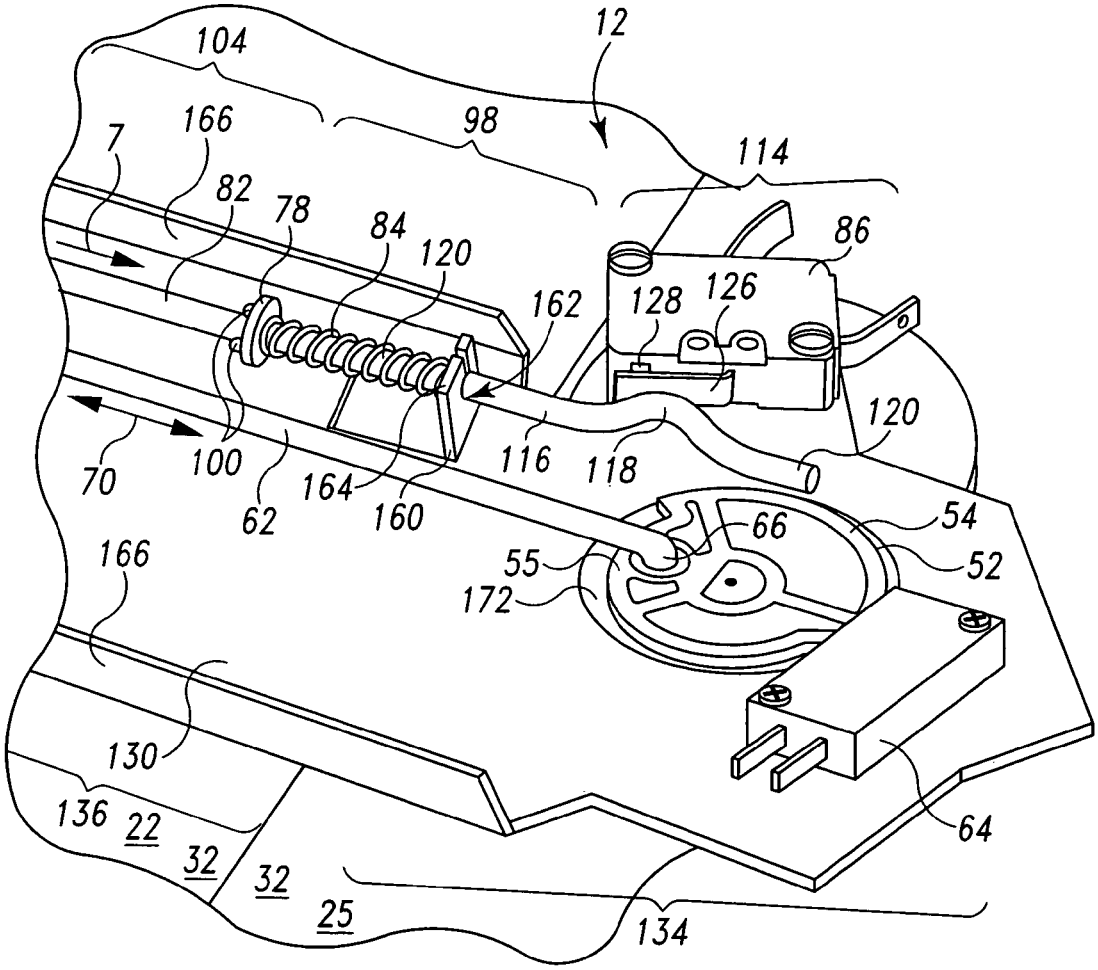
FIG. 6 is a perspective view with parts broken away of the rear portion of the oven and oven lock mechanism of FIG. 2 in an unlatched position with the motor-enabling switch not actuated.
Figure 7:
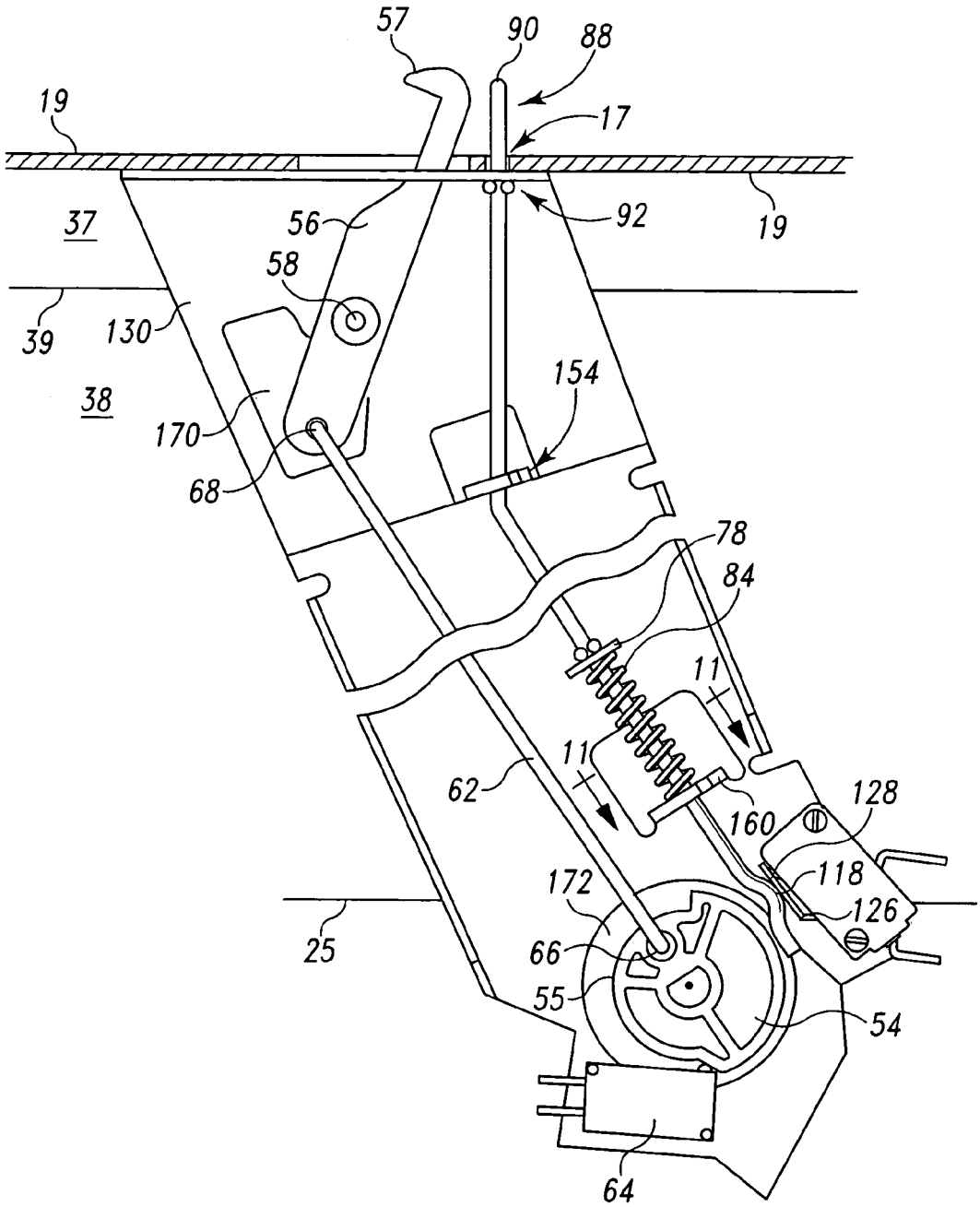
FIG. 7 is a plan view with parts broken away of the oven and oven lock mechanism of FIG. 2 showing the oven door in an open position and the oven lock mechanism in an unlatched position and the motor-enabling switch disabling the motor.

As shown, generally, in FIGS. 2 and 3, and more specifically in FIGS. 4–6, the first illustrated embodiment of oven lock mechanism 30 includes a latch mechanism 50 and a motor-enabling switch actuator mechanism 80 both of which are mounted on a mounting plate 130 configured to facilitate the locking and switch actuation functions.

Those skilled in the art will recognize that the latch mechanism 50 of the first and second embodiments of oven lock mechanism 30, 230 are substantially identical and therefore will be described in detail only with regard to oven lock mechanism 30. Also, the mounting plate 130, 230 of the first and second embodiments of the oven lock mechanism 30, 230 are substantially similar and thus identical reference numerals are used in describing both embodiments to identify identical or substantially identical components. Because of the similarity between the first and second embodiments of oven lock mechanism 30, 230, the components of oven lock mechanism 30 are described in detail with the understanding that such description applies to oven lock mechanism 230.

The latch mechanism 50 of the first and second embodiment of the oven lock mechanism 30, 230 functions to lock the oven door 26 in a closed and sealed position so that the oven door 26 may not be opened when the oven 12 is in a self-cleaning mode. The latch mechanism 50 includes appropriately configured portions of the mounting plate 130 and a motor 52, a cam 54, a latch 56, a pivot pin 58 and a rod 62 coupling the latch 56 to the cam 54. The components of the latch mechanism 50 work together to move the latch 56 between three different positions, an unlatched position, a latched position and a latched and sealed position. The oven door 26 may be opened when the latch 56 is in an unlatched position. The oven door 26 may not be opened when the latch 56 is in either its latched position or latched and sealed position. The motor 52 of the illustrated latch mechanism 50 is activated by power lines (not shown) located generally behind the rear wall 25 of the oven cavity 24.

As shown, for example, in FIGS. 2–10, the motor-enabling switch actuator mechanism 80 includes appropriately configured portions of the mounting plate 130 and a spring seat 78, an actuator rod 82, a bias spring 84 and a motor-enabling switch 86 mounted to the mounting plate 130. The motor-enabling switch 86 of the switch actuator mechanism 80 is electrically coupled to open or close the power lines to enable or disable, energize or de-energize the motor drive circuit. Those skilled in the art recognize that the enablement and disablement of the motor drive circuit by the switch 86 can be implemented in many different manners. Most simply, one or more of the power lines can be coupled through the switch 86 to the motor 52 so that if the switch 86 is in an open state, the power supply to the motor 52 includes an open circuit and when the switch 86 is in a closed state, the power supply to the motor 52 forms a closed circuit. Typically, however, certain control systems implement well known algorithms to control the pyrolytic cleaning cycle and check the state of the switch 86 to determine the state of the oven door 26 prior to implementing a door locking step including the step of rotating the cam 54 using the motor 52 to cause the latch 56 to latch and pull-in the oven door 26.

As shown, for example, in FIG. 3, the illustrated outer metallic wall 32 of the top wall 22 of the oven cavity 24 includes an upper top surface 37 adjacent the front frame wall 19, a lower top surface 38 and a vertical wall 39 extending between the upper top surface 37 and lower top surface 38. The lower top surface extends between the vertical wall 39 and the outer wall 32 of the back wall 25 of the oven cavity 24. The mounting plate 130 is mounted to be supported by this outer wall 32 of the top wall 21 of the oven cavity 24 and thus has certain structural features that conform to the outer wall 32 of the top wall 21 of the oven cavity 24.

The mounting plate 130 extends generally from the back of the range 10 to the front of the range 10 and is secured to the front wall 19 of the range 10 with fasteners. The mounting plate 130 is located below the top 21 of the range 10 and supported above the outer metallic wall 32 of the top wall 22 of the oven cavity 24. Thus, the mounting plate 130 of the illustrated embodiment of oven lock mechanism 30 is configured to be mounted to the outer wall 32 of the top wall 21 of the oven cavity 24. To facilitate mounting the mounting plate 130 to the top wall 21, the mounting plate 130 includes a front portion 132, a rear portion 134 and a middle portion 136 extending between and coupling the front portion 132 and the rear portion 134. The front portion 132 is formed to include a substantially planar mounting surface 138, an upwardly extending front lip 140 and a downwardly extending rear flange 141. The mounting surface 138 and front lip 140 are configured to facilitate mounting the latch 56 for pivotal and reciprocal movement relative to the mounting plate 130. The mounting surface 138 and front lip 140 are also configured to facilitate mounting the actuator rod 82 for reciprocal forward and rearward movement relative to the mounting plate 130. The mounting surface 138 and front lip 140 are configured to facilitate attaching the mounting plate 130 to the frame of the oven 12 in a position centrally located above and adjacent to the front opening of the oven cavity 24.

The mounting plate 130 is supported by the range body above the oven cavity 24 in a generally horizontal orientation as seen in FIGS. 1–3. In the illustrated embodiment, the mounting plate 130 includes a top surface 142 and a bottom surface 144 from which various structures extend and to which various components are mounted to implement the latch mechanism 50 and switch actuator mechanism 80 of the oven lock mechanism 30. Front lip 140 includes a front surface 146 for engaging the rear wall of the front top wall 19 of the frame. The front lip 140 abuts the front wall 19 of the range body and has a pair of holes therein through which the fasteners pass to secure the front lip 140 of the mounting plate 130 to the front wall 19 of the range body. Front lip 140 is formed to include openings extending between the front surface 146 and a rear surface 148 to form a rectangular latch opening 150 and a plunger portion receiving hole 152.

The mounting plate 130 is formed to include a guide channel 170 extending through the front portion 132 of the mounting plate 130 between the top surface 142 and the bottom surface 144. The guide channel 170 is an opening defined by walls of a particular configuration comprising a narrow front section and a relatively wider back section between which is located a middle section. The size and configuration of the guide channel 170 limit the movement of the latch 56 in a manner described in more detail below.

As shown for example, in FIGS. 1–3 the mounting plate 130 is configured to facilitate mounting the motor 52 and the cam 54 to the rear portion 134 of the mounting plate 130. Illustratively, the rear portion 134 of the mounting plate 130 extends rearwardly beyond the outer wall 32 of the back wall 25 of the oven compartment 24. The cam 54 is secured to D-shaped shaft of the motor 52 so that rotation of the motor 52 causes the cam 54 to rotate about a vertical axis. Illustratively, motor 52 is mounted to the underside of the rear portion 134 of the mounting plate 130. The rear portion 134 of the mounting plate 130 is formed to include a cam opening 172 that allows the cam 54 to freely rotate when activated by the motor 52.

The latch rod 62 extends between the cam 54 and the latch 56. In the illustrated embodiment, the latch rod 62 extends generally from the front to the back of the range 10. The latch rod 62 has a cam end 66 which is secured to the cam 54 and a latch/guide end 68 which is secured to the latch 56 and extends into the channel 170 to guide the latch 56. The latch rod 62 is located generally above the mounting plate 130 and moves in a linear manner depicted by the arrows 70 (shown in FIGS. 5, 6) as the cam 54 rotates.

The latch 56 of door latch mechanism 50 is best illustrated in FIG. 5. The latch 56 has a hook 57 located at a front end 59, and a hole 61 at a rear end 63. Between the front end 59 and the back end 63, the latch 56 is adapted to receive the pivot pin 58. The pivot pin 58 is secured to the latch 56 and extends downwardly therefrom in a fixed location, as shown, for example, in FIG. 5 and extends into guide slot 170. The pivot pin 58 has a circular head 67 which prevents the latch 56 from being pulled out of position. On its bottom end, pivot pin 58 is formed to include a head that rests on the bottom walls of the slot 170 while the pivot pin 58 travels inside the slot 170 as the latch 56 moves between positions.

Figure 8:
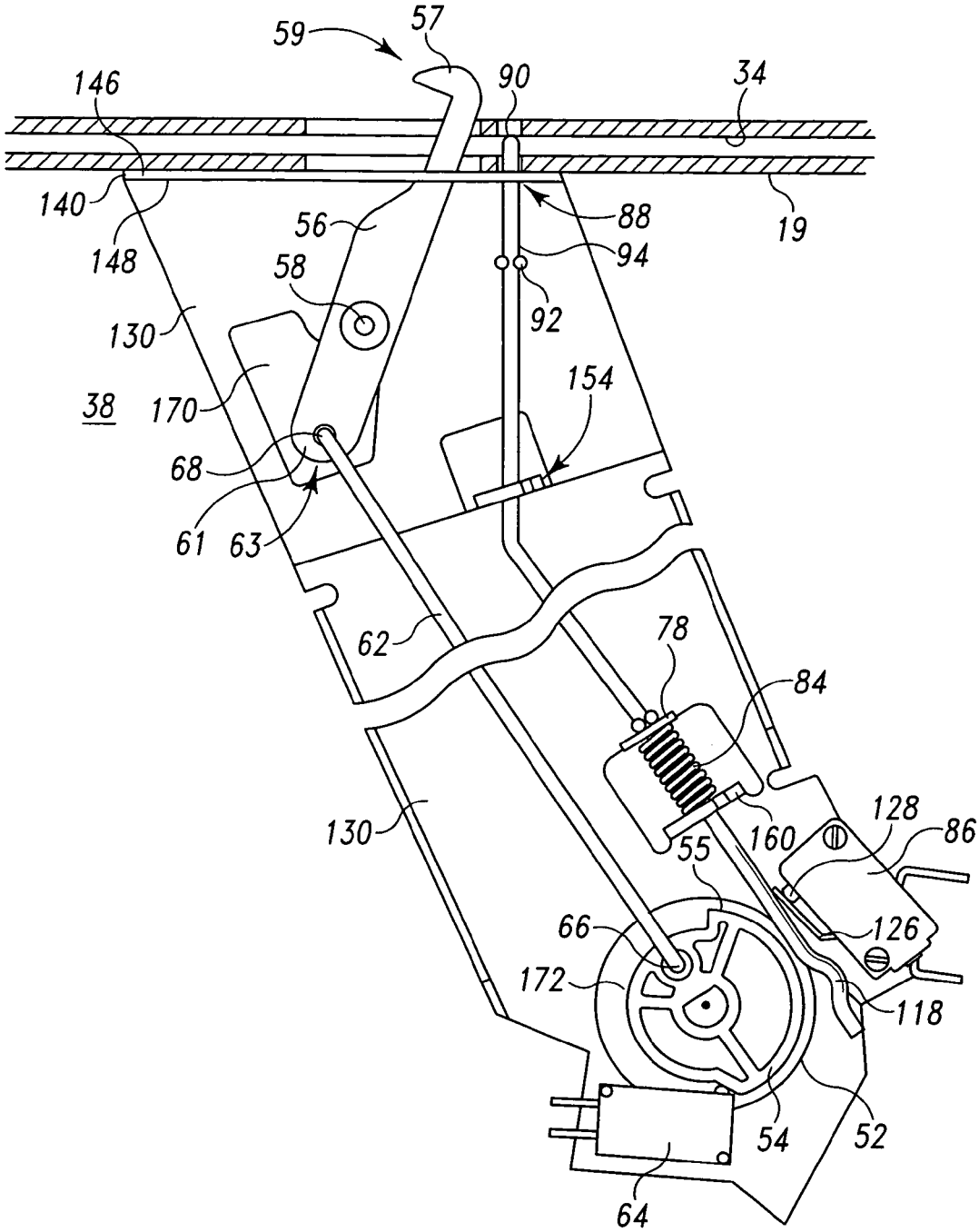
FIG. 8 is a view similar to FIG. 7 showing the oven door in a closed position, the oven lock mechanism in an unlatched position and the motor-enabling switch enabling the motor.
Figure 9:
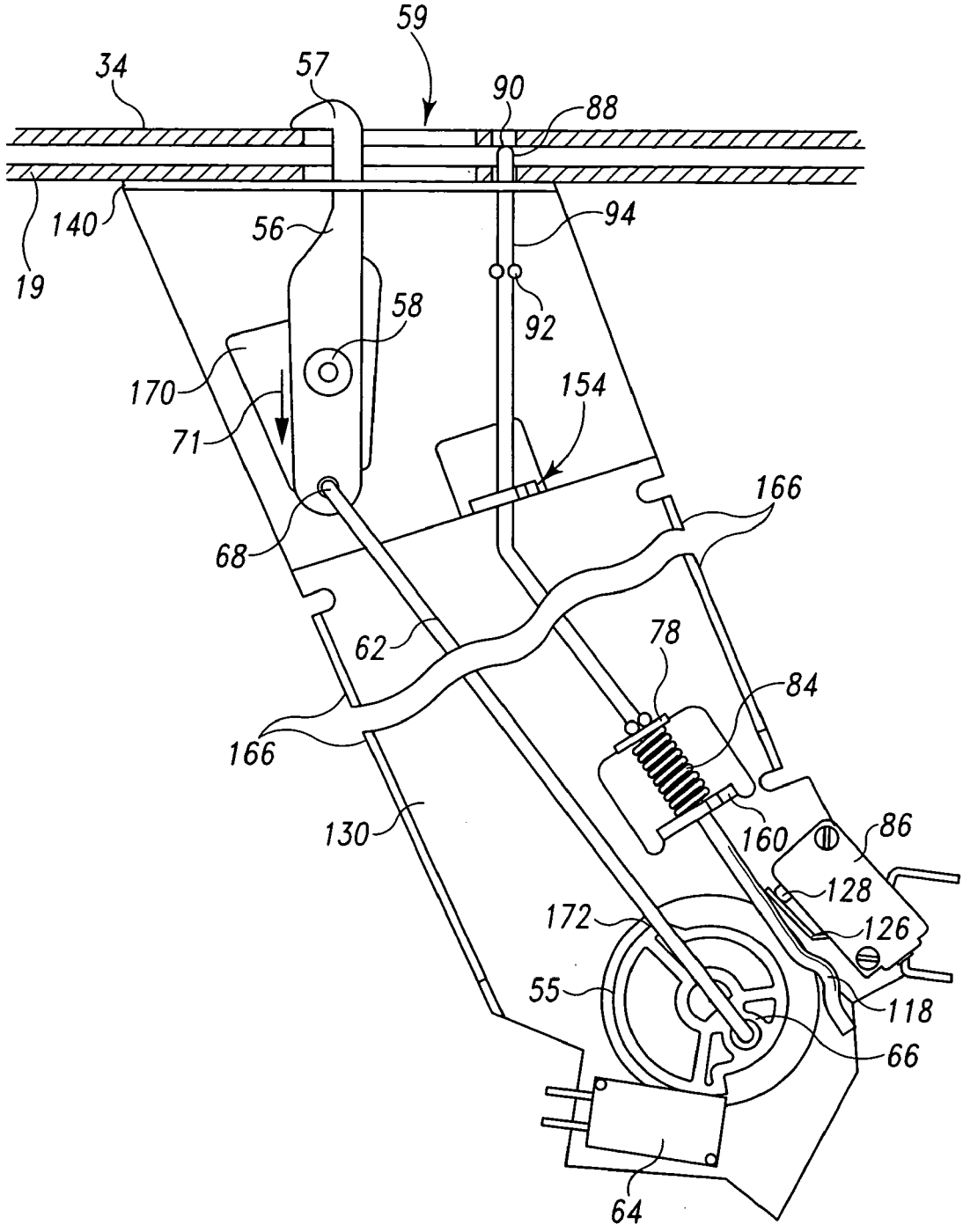
FIG. 9 is a view similar to FIG. 8 showing the oven door in a closed position, the oven lock mechanism in a latched position and the motor-enabling switch enabling the motor.
Figure 10:
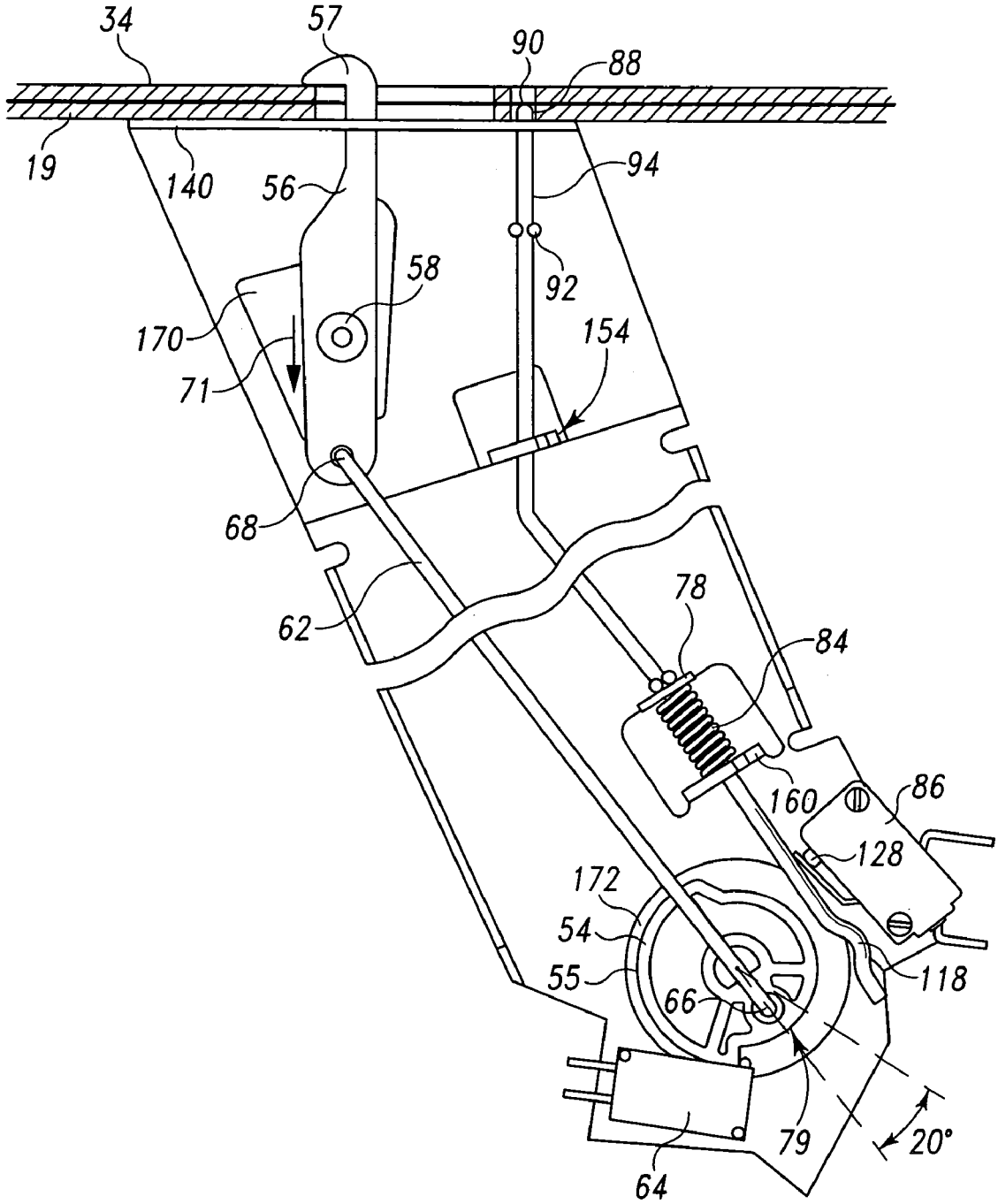
FIG. 10 is a view similar to FIG. 7 showing the oven door in a closed position, the oven lock mechanism in a latched and pulled-in position and the motor-enabling switch enabling the motor.

As previously stated the latch 56 is movable between three positions: an unlatched position, a latched position and a latched and sealed position. The unlatched position of the latch 56 is shown in FIGS. 4, 5, 7, 8. In the unlatched position, the hook 57 of the latch 56 is aligned with an opening 69 in the back wall 34 of the oven door 26. With the latch 56 in this unlatched position, the oven door 26 may be freely opened and closed as the hook 57 of the latch 56 passes freely through the opening 69 in the oven door 26. As the latch rod 62 translates rearwardly due to activation of the motor 52 and consequent rotation of the cam 54, the latch 56 moves to its latched position, which is shown in FIG. 9. In this position, the oven door 26 may not be opened because the hook 57 of the latch 56 catches the back wall 34 of the oven door 26 in a manner depicted in FIG. 9. Upon further rearward translation of the latch rod 62, the latch 56 is pulled rearwardly in the direction of arrow 71 to its latched and sealed position in which the oven door 26 is locked and sealed, as shown, for example, in FIGS. 3, 10. In the latched and sealed position, the seal or gasket 45 is compressed between the forward facing wall 42 of the recessed region 40 of the frame surrounding the opening of the oven cavity 24 and the peripheral wall 46 surrounding the plug portion 44 of the protrusion of the back wall 34 of the oven door 26. In the latched and sealed position the oven door 26 is correctly sealed and seated so as to provide a tight seal for the oven cleaning process.

As best illustrated in FIG. 5, the latch/guide end 68 of the latch rod 62 comprises a vertical section 72 and a horizontal section 73 which terminates in an end. The hole 61 in the latch 56 is sized so as to have a diameter slightly larger than the diameter of the vertical section 72 of the latch rod 62 so that the vertical section 72 of the latch rod 62 passes through the hole 61 in the latch 56 and through the guide channel 170 in the mounting plate 130 with the horizontal section 73 of the latch rod 62 being located below the mounting plate 130. The horizontal section 73 of the latch rod 62 prevents the latch rod 62 from separating from either the latch 56 or the mounting plate 130 as the vertical section 72 of the latch rod 62 moves inside the guide channel 170 upon translation of the latch rod 62.

In operation, upon activation of the motor 52, the cam 54 rotates, causing the latch rod 62 to translate along the direction of arrow 71. Upon rearward translation of the latch rod 62, the latch 56 moves from its unlatched position to its latched position (FIG. 9) in which the oven door 26 is prevented from opening. Upon further translation of the latch rod 62, the latch 56 is pulled rearwardly to its latched and sealed or pulled-in position (FIG. 10) in which the oven door 26 is in a locked and sealed position with the peripheral wall 46 surrounding the plug portion 44 of the protrusion 43 of the back wall 34 of the oven door 26 and the forward facing wall 42 of the recessed region 40 compressing the gasket 45 located between the oven door 26 and the front wall 19 of the range body (see FIG. 3).

In the illustrated embodiment (FIG. 10), when the cam 54 reaches a position where the cam end 66 of the latch rod 62 is ten degrees before top dead center 79, the follower surface 55 of the cam 54 disengages from the contact of the switch 64 inducing a change in state in the cam-actuated latch position switch 64 indicating that the door 26 is latched and sealed. At this time, the motor 52 stops turning and the self cleaning cycle begins. Until a timer expires, the motor 52 is disabled by the control circuitry of the self-cleaning oven in a known manner. Because the motor 52 stops before top dead center 79, an effort to open the oven door 26 requires the user to overcome the detent force of the motor 52. Typically because of the configuration of the cam 54 and the location of the cam 54 when it stops, insufficient torque can be generated by the user to overcome the detent force of the motor 52. Thus the user is unable to override the lock by simply pulling on the door handle 28.

After completion of the cleaning cycle, the motor 52 again turns the cam 54 causing the latch rod 62 to reciprocate forward. Latch 56 is pushed forward by latch rod 62 causing the rear of the latch 56 to move in a forward and sideways direction. The latch 56 rotates and slides about the pivot pin 58 and the pin 58 moves inside the slot 170 so that the latch 56 is moved to its unlatched position. With the latch 56 in its unlatched position, the oven door 26 may be opened.

While partially explained above, the operation of the latch mechanism 50 is more fully explained in co-pending U.S. patent application Ser. No. 10/877,151, entitled Motorized Oven Door Lock with Pull-In Capabilities by Harry I. Courter, Matthew L. Kemp and Tracy J. Talley, which is assigned to the same assignee as the present invention, and which is filed concurrently herewith, the disclosure of which is hereby totally incorporated by reference in its entirety. Before the latch mechanism 50 can operate to latch and seal the door 26, the motor drive circuit must be enabled by actuating the motor-enabling switch 86. In the illustrated embodiment, the motor drive circuit is enabled by a switch actuator mechanism 80 mounted to the frame of the range 10 to interact with the center of the oven door 26 to actuate the motor-enabling switch 86 mounted at the rear of the oven 12 when the door is closed, as shown, for example, in FIG. 8.

In the illustrated embodiment of oven lock mechanism 30, actuator rod 82 of switch actuator mechanism 80 includes a plunger portion 88, a linkage portion 104, a bias portion 98, and a switch actuator portion 114. In the illustrated embodiment of oven lock mechanism 30, actuator rod 82 is formed from a metal rod bent, shaped and deformed to form a plunger portion 88 coupled through the linkage portion 104 to the bias portion 98 that is coupled to the actuator portion 114.

Those skilled in the art will recognize that the specific arrangement of the various portions is not critical to the disclosed switch actuator mechanism 80. The illustrated switch actuator mechanism 80 is configured to actuate the motor-enabling switch 86 mounted away from the high temperature region adjacent the oven opening. It is within the scope of the disclosure for the bias portion 98 to be located adjacent the plunger portion 88. Those skilled in the art will recognize that by providing a spring seat in engagement with the back of stop 92 a compression spring could easily be compressed between such stop 92 and the front mounting flange 154 of the mounting plate 130 to urge the plunger portion 88 forward. Likewise, the linkage portion 104 could be configured to include a front linkage portion and a rear linkage portion with the bias portion disposed therebetween. It is also within the scope of the disclosure for the bias portion to be disposed at the end of the switch actuator portion 114.

In the illustrated embodiment, the plunger portion 88 is configured to reciprocate forwardly and rearwardly within a plunger mounting hole 152 formed in the front lip 140 of the mounting plate 130 and a corresponding hole 17 extending through the front wall 19 of the oven frame. Plunger portion 88 includes a rounded door-engaging end 90 and a mounting plate-engaging stop 92. A cylindrical shaft portion 94 sized to be received in holes 152 and 17 extends between the rounded door-engaging end 90 and the stop 92. Illustratively, the stop 92 is formed by pinching the metal rod material of actuator rod 82 to form two radially projecting ears. The radially projecting ears forming stop 92 engage the inside wall 148 of the lip 140 of the mounting plate 130 adjacent the mounting hole 152 to stop the forward reciprocal movement of the actuator rod 82.

In the illustrated embodiment the actuator rod 82 is urged forward by the bias spring 84. As shown, for example, in FIG. 6, the rod material from which actuator rod 82 is formed is deformed in the bias region 98 by pinching the rod to form two radially extending ears 100. In the other areas of bias region 98 actuator rod 82 is not deformed and therefore forms a shaft 102 sized to be received in a channel 162 formed in the upwardly extending rear guide flange 160 of the mounting plate 130. The two ears 100 act as a stop against which a spring seat 78 is urged by bias spring 84. Illustratively, spring seat 78 is a washer with a central opening sized to be received over the actuator rod 82. It is within the scope of the disclosure for spring seat 78 to be formed in other manners including, but not limited to, forming a hole extending through actuator rod 82 through which an end of bias spring 84 extends, forming ears 100 of sufficient size, or otherwise deforming rod 82, to act as a spring seat 78 and building up rod 82 through welding or the like to form a spring seat 78.

Bias spring 84 is a compression spring having a central longitudinal opening therethrough. Shaft 102 of actuator rod 82 is received in longitudinal opening of the bias spring 84. Bias spring 84 thus surrounds shaft 102 and extends between guide flange 160 and spring seat 78 to urge the actuator rod 82 forward. When the oven door 26 engages rounded end 90 of the plunger portion 88 of the actuator rod 82 and urges actuator rod 82 rearwardly from the position shown in FIG. 7 to the position shown in FIG. 8, then bias spring 84 is compressed between the front wall of the guide flange 160 and the spring seat 78 to store a restorative force to return actuator rod 82 forward when the oven door 26 is opened. Forward movement of actuator rod 82 is stopped when the stop 92 engages the inner wall 148 of the lip 140 of the mounting plate 130.

In the illustrated embodiment, the linkage portion 104 of the actuator rod 82 extends rearwardly from the plunger portion 88 to couple the plunger portion 88 to the bias portion 98. In the illustrated embodiment, linkage portion 104 includes a front shaft portion 106 coupled to the stop 92 of the plunger portion 88 and extending rearwardly therefrom through a channel 156 in the front guide flange 154 of the mounting plate 130. After passing through the channel 156 in the front guide flange 154, actuator rod 82 bends laterally to form an dogleg shaft 108 extending rearwardly to align the remainder of the actuator rod 82 for proper interaction with the motor-enabling switch 86. In the illustrated embodiment a vertical offset shaft 110 extends downwardly from the distal end of the dogleg shaft 108. Vertical offset shaft 110 is present to vertically align the switch actuator portion 114 of the actuator rod 82 with the contact 128 of the switch 86. A rear shaft 112 of the linkage portion 104 is coupled to the bottom of the vertical offset shaft 110 and extends rearwardly therefrom. The rear shaft 112 is coupled to the bias region 98 so that the longitudinal axes of the rear shaft 112 and the shaft 102 of the bias region 98 are co-linear. Illustratively, the ears 100 forming the stop serve to define the dividing point between the linkage portion 104 and the bias region 98 of the actuator rod 82.

In the illustrated embodiment of switch actuator mechanism 80, actuator rod 82 is appropriately bent to form the front shaft portion 106, the dogleg shaft 108, the vertical offset shaft 110 and the rear shaft 112 of the linkage portion 104. As a result of the bending operations, the bias portion 98 of the actuator rod 82 is properly aligned with the channel 162 in the rear guide flange 160 and the switch actuator portion 114 of the actuator rod 82 is properly aligned with the contact 128 of the motor-enabling switch 86.

After extending through the channel 162 of the rear guide flange 160, actuator rod 82 is formed to include a switch actuator portion 114. As shown, for example, in FIGS. 4–6, the earlier described bends and shafts of the actuator rod 82, the position of the channels 156, 162 in the guide flanges 154, 160, respectively, and the mounting location of the motor-enabling switch 86 cause the longitudinal axis of the rear proximal shaft 116 and the distal shaft 120 of the switch actuator portion 114 of the actuator rod 82 to extend parallel to the contact 128 of the motor-enabling switch 86.

Illustratively, motor-enabling switch 86 is a snap-type switch with a pivoting lever arm 126 actuating the switch contact 128. Those skilled in the art will recognize that snap-type switches are typically less expensive than alternative types of switches. While it is within the scope of the disclosure to use switch types other than snap switches to serve as the motor-enabling switch 86 of the oven lock mechanism 30, utilization of snap switches results in a significant cost savings as compared to the utilization of plunger type switches. Additionally, as shown, for example, in FIGS. 18, 19, dual switch actuator levers 726 are available so that movement of the lever 726 can actuate two stacked snap switches 86, 87. It is within the scope of the disclosure to utilize such stacked switches 86, 87 in any of the illustrated or non-illustrated embodiments of the oven lock mechanism.

In order to selectively engage and disengage the lever arm 126 actuating the contact 128 of the motor-enabling switch 86, actuator rod 82 is formed to include a proximal shaft 116, a C-shaped laterally extending bend 118 and a distal shaft 120 in the actuator region 114. In the illustrated embodiment, as shown, in FIGS. 6, 7, when the door 26 is open and actuator rod 82 is in its forward position, bend 118 engages the lever arm 126 actuating the contact 128 of the motor-enabling switch 86 depressing the contact 128 to place the switch 86 in a first state. Since the illustrated switch 86 is a normally closed switch, when the contact 128 is depressed, the illustrated switch 86 is in an open state when the door 26 is open. When the door 26 is closed, actuator rod 82 is urged rearwardly, as shown in FIG. 8, causing switch actuator section 114 to reciprocate rearwardly moving bend 118 rearwardly allowing lever arm 126 to pivot away from contact 128 of switch 86 inducing the switch 86 to change from a first state to a second state. When the switch 86 is in this second state, the motor drive circuitry is enabled so that, if a user selects the self cleaning option, the motor 52 will rotate the cam 54 to move the latch 56 to the latched and latched and pulled-in positions.

Figure 12:
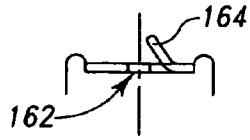
FIG. 12 is a top view of the switch actuator rod guide flange of FIG. 11 with the upper tab bent to facilitate insertion or removal of the switch actuator rod.
Figure 11:
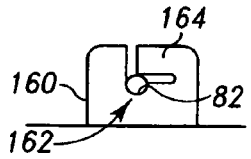
FIG. 11 is view taken along line 11—11 of FIG. 7 showing the switch actuator rod guide flange.

While described as showing the rear guide flange 160 of first embodiment of mounting plate 130, FIGS. 11–12 are equally as applicable to rear guide flange 160 of the second embodiment of mounting plate 330 and to the front guide flange 154 of either first or second mounting plate 130, 330. Three sides of the rectangular flange 160 are cut from the mounting plate 130. The flange 160 is bent along the fourth side to extend upwardly from the top surface 142 of the mounting plate 130. A hole sized to receive the actuator rod 82 therein and act as a channel 162 for guiding the reciprocal movement of the rod 82 is formed in the flange 160 at the appropriate location by drilling, punching or the like. An L-shaped cut is made through the top of the flange 160 intersecting with the hole 162 leaving a cantilevered upper arm or tab 164 extending over the hole 162 as shown, for example in FIG. 11.

In the illustrated mounting plate 130, the cantilevered arm 164 is bent rearwardly to expose the channel 162 from above, as shown, for example, in FIG. 12. The actuator rod 82 is inserted into the channel 162 in rear guide flange 160 from above and the cantilevered arm 164 is bent back toward its initial position to secure the actuator rod 82 within the channel 162 as shown, for example, in FIGS. 4–13. Similarly, in the illustrated oven locking mechanism 30, 230, the actuator rod 82, 282 is inserted into the channel 156 in front guide flange 154 from above and the cantilevered arm 158 is bent back toward its initial position to secure the actuator rod 82, 282 within the channel 156 as shown, for example, in FIGS. 4–13.

Other guides may be provided for guiding the rod 82 within the scope of the disclosure. Such guides may be formed as described above or may be formed separately and be subsequently mounted to the mounting plate 130. The illustrated and described front and rear guide flanges 154, 160, however, are easily and inexpensively formed in the mounting plate 130 and thus aid in reducing the cost of forming the mounting plate 130. Those skilled in the art will recognize that disclosed mounting plate 130 may be easily and inexpensively formed by appropriately pressing, cutting, bending, drilling and forming a sheet of metal. All of the above described structures and components of the mounting plate 130 are formed through such fabrication techniques. Other components of the mounting plate 130, such as the upwardly extending side walls 166 of that create structural rigidity in middle portion 136 of the mounting plate 130 are also formed through such fabrication techniques.

The second embodiment of lock mechanism 230 is virtually identical to the first embodiment of oven lock mechanism 30 and thus only differences between the two embodiments will be described. Because of the similarities between the two embodiments the same reference numerals will be used in identifying identical components and similar reference numerals will be used in identifying similar components. The second embodiment of oven lock mechanism 230 includes a latch mechanism 50, a switch actuator mechanism 280 and a mounting plate 330. Mounting plate 330 differs from mounting plate 130 by including a guide and anti-rotation flange 380 extending upwardly from the top surface 142 of the rear portion 334 of the mounting plate 330. Switch actuator mechanism 280 differs from switch actuator mechanism 80 by including an anti-rotation portion 321.

Figure 14:
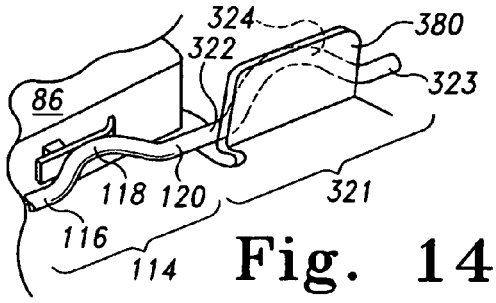
FIG. 14 is a perspective view of the end of the switch actuator rod and a guide surface of the switch actuator mechanism of FIG. 13.
Figure 13:
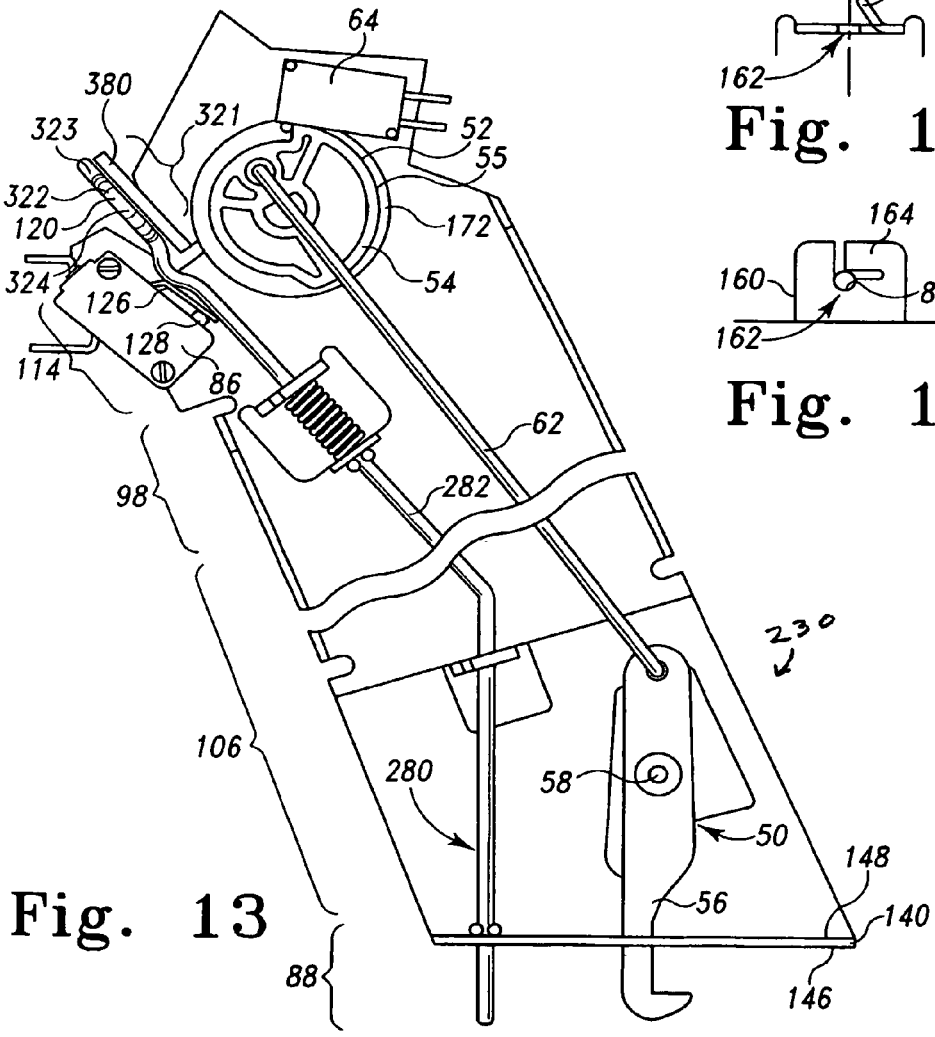
FIG. 13 is a plan view with parts broken away of the second embodiment of an oven lock mechanism showing a second embodiment of the switch actuator mechanism and mounting plate.

As shown, for example, in FIGS. 13–14, the anti-rotation portion 321 of actuator rod 282 and the guide and anti-rotation flange 380 of the mounting plate 330 facilitate engagement and disengagement of the C-shaped laterally extending bend 118 in the switch actuator portion 114 with the lever arm 126 actuating the contact 128 of the switch 86. In the actuator arm 82, the distal shaft 120 of the switch actuator portion 114 is formed to have a longitudinal axis co-linear with the longitudinal axis of the front shaft 116 and the C-shaped bend 118 extends laterally or horizontally away from the front shaft 116 and the rear shaft 118 to provide a horizontally displaced actuator surface for engaging the actuator lever 126 of the switch 86. In the actuator rod 82, the actuator portion 114 is located adjacent the rear guide flange 160 of the mounting plate 130 and thus rear guide flange 160 alone is sufficient, based on the flexibility of the actuator rod 82 and the short length of rod extending rearwardly from the rear guide flange 160, to maintain bend 118 in engagement with the actuator lever 126.

However, as shown in FIGS. 13–14, additional structures may be provided within the scope of the disclosure to help maintain the alignment of the actuator rod 282 with the motor-enabling switch 86. Actuator rod 282 is substantially similar to actuator rod 82. However, actuator rod 282 includes an anti-rotation and guide portion 321 extending rearwardly from rear shaft 120 of the switch actuator portion 114. The anti-rotation portion 321 of actuator rod 282 includes a front shaft 322, a rear shaft 323 and a C-shaped vertically extending bend 324. The front shaft 322 of the anti-rotation portion 321 of actuator rod 282 is coupled to the rear shaft 120 of the actuator portion 114 and extends rearwardly therefrom. Front shaft 322, rear shaft 323 and C-shaped vertically extending bend 324 ride adjacent to, or in engagement with, upwardly extending guide flange 380 of mounting plate 330 as shown, for example, in FIGS. 13 and 14. The engagement of vertically extending guide flange 380 and vertically extending bend 324 inhibits rotation of actuator rod 282 about its longitudinal axis. Flange 380 also prevents lateral movement of actuator rod 282 away from the actuator lever 126 of motor enabling switch 86.

Figure 16:
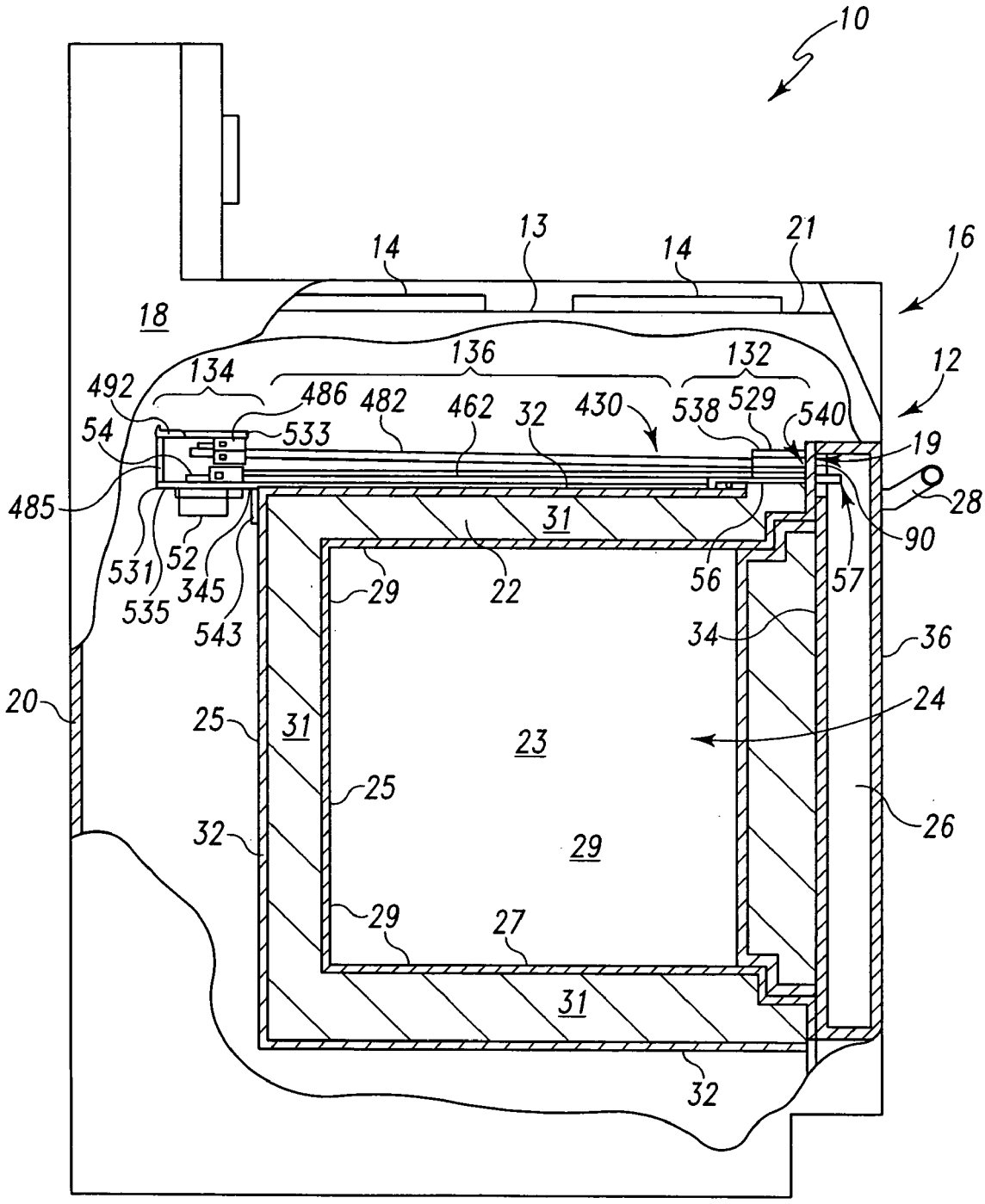
FIG. 16 is a side elevation view with parts broken away of the oven lock mechanism of FIG. 15.

As shown, for example, generally in FIGS. 15–22 and more particularly in FIGS. 15 and 16, the third and fourth embodiments of an oven lock mechanism 430, 630 are configured for mounting to a range 10 having a self cleaning oven 12. The range 10 is virtually identical to range 10 described in conjunction with the first embodiment if oven lock mechanism 30. As shown, in FIGS. 1–3 and 15–16, range 10 does not differ between the first and second embodiments and the third and fourth embodiments, rather the oven lock mechanisms 30, 230 and 430, 630 mounted to the range 10 differ as does the manner of mounting the oven lock mechanisms 30, 230 and 430, 630 to the range 10. In the first and second embodiments, the oven lock mechanism 30, 230 is mounted on a single mounting plate 130, 330 mounted to the top of the oven 12 and extending from the front to beyond the rear of the oven 12. In the third and fourth embodiments, the components of the oven lock mechanism 430, 630 are mounted on two mounting plates 529, 531 and 729, 731. One mounting plate 529, 729, on which less heat sensitive components are mounted, is mounted at the top front of the oven 12. The remainder of the components, including the more heat sensitive components, are mounted on a rear mounting bracket 531, 731 at the top rear of the oven 12.

As shown for example in FIGS. 15–21, a third embodiment of a motorized oven lock mechanism 430 includes a latch mechanism 450, a switch actuator mechanism 480, a front mounting plate 529 and a rear mounting bracket 531. In the illustrated embodiment, the latch mechanism 50 includes appropriately configured portions of the front mounting plate 529 and the rear mounting bracket 531, a latch 456 and a latch pivot pin 458 mounted to the front mounting plate 529, a motor and gear box 52, a cam 54 and a cam-actuated switch 448 mounted to the rear mounting bracket 531 and a latch rod 462 coupling the latch 456 to the cam 54. The switch actuator mechanism 480 includes appropriately configured portions of the front mounting plate 529 and the rear mounting bracket 531, a plunger pin 488 and a bias spring 486 mounted to the front mounting plate 529, a lever actuated motor-enabling switch 486, an actuator lever 514 and a lever pivot pin 520 mounted to the rear mounting bracket 531 and an actuator rod 482 coupling the plunger 488 to the lever 514.

Figure 17:
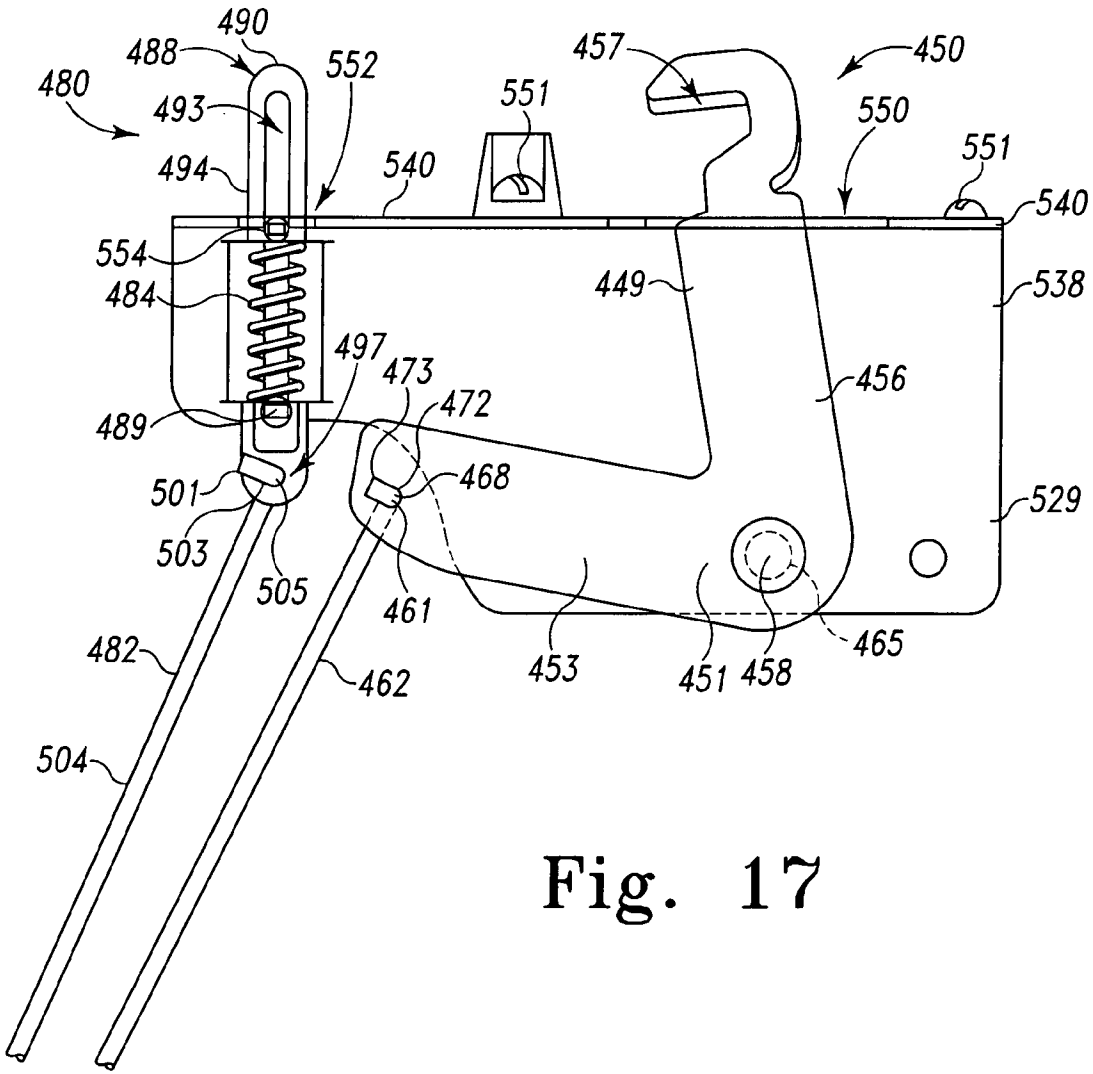
FIG. 17 is a bottom plan view looking up of a front portion of the third and fourth embodiments of an oven lock assembly of FIG. 15, showing a spring biased plunger mounted for reciprocal movement to a front mounting plate and coupled to an actuator rod and a latch pivotally mounted to the front mounting plate and coupled to a latch rod.

As shown, for example, in FIG. 17, the latch 456, latch pivot pin 458, plunger pin 488 and one end of each of the rods 462, 482 are coupled or mounted to the front mounting plate 529. The latch 456 and latch pivot pin 458 are mounted to the front mounting plate to facilitate rotational or pivotal movement of the latch 456 relative to the mounting plate 529 about a an axis extending through the pivot pin 458. The plunger pin 488 is mounted to mounting plate 529 for reciprocal movement forwardly and rearwardly with respect to the mounting plate 529. The bias spring 484 is mounted to the front mounting plate 529 and the plunger pin 488 to bias the plunger pin 488 in the forward position. All of these components in the illustrated oven lock 430 are made of metal, such as polished nickel, and are very heat tolerant.

The rounded end 490 of the plunger pin 488 of the actuator mechanism 480 and the hook 457 of the latch 456 extend forwardly beyond the front wall 19 of the frame of the oven 12 to interface with the oven door 26. When the oven door 26 is closed, the inside wall 34 of the door 26 engages and depresses the plunger pin 488. The plunger pin 488 urges the actuator rod 482 rearwardly inducing rotation of the lever 514 to actuate the motor-enabling switch 486. After the switch 486 is actuated, if a user selects the self-cleaning cycle, the motor 52 turns the cam 54 which urges the latch rod 462 to rotate the latch 456 to a position that traps the door 26.

Reciprocal movement of the plunger pin 488 is transferred through actuator rod 482 to the lever 514 mounted on the rear mounting bracket 531 for pivotal movement relative thereto about an axis extending through the lever pivot pin 520. The lever actuated switch 486 is activated by rotation of the lever 514 induced by rearward reciprocal movement of the plunger pin 488. Upon being activated, the lever-actuated switch 482 enables the self-cleaning function of the oven 12. If self-cleaning is selected, typically by a user actuating a switch on the oven control panel, a circuit is closed driving the motor and gear box 52 to rotate the cam 54. The cam 54 rotates to a locked position that pulls the latch rod 462 rearwardly inducing rotation of the latch 456 about the pivot pin 458 moving the hook 457 of the latch 456 into engagement with the door 26. During rotation of the cam 54 to the locked position, the cam 54 becomes disengaged from the contact button 475 of the cam-actuated switch 464. The cam-actuated switch 464 signals to the electronic package a change in state of the latch 456.

As shown, for example, in FIG. 17, oven lock mechanism 430 includes a plunger pin 488. Plunger pin 488 is moved against a spring bias exerted by the bias spring 484 to a depressed position every time the oven door 26 is closed. In response to this action, the motor-enabling switch 486 is actuated regardless of whether or not the oven 12 is to be placed in a self-cleaning mode of operation. When a user does place the oven 12 in the self-cleaning mode, an oven controller actuates the motor and gear box 52 to drive the cam 54 to a locking position. When cam 54 is placed in such locking position, the latch 456 is rotated into engagement with the door 26 so that any attempt to open the oven door 26 will be unsuccessful. Once the self-cleaning cycle is completed, the oven controller actuates the motor and gear box 52 to drive the cam 54 back to an unlatched position which urges the latch 456 to its unlatched position.

More particularly, the front mounting plate 529 of the oven lock mechanism 430 is mounted to the top front wall 19 of the oven frame. The front mounting plate 529 of the oven lock mechanism 430 is positioned relative to the frame so that the hook 457 of the latch 456 and the rounded end 490 of the shaft 494 of the plunger pin 488 extend forwardly beyond the front wall 19 of the oven frame when the oven door 26 is opened. This is to permit the oven door 26 to engage the rounded end 490 of the plunger pin 488 during closing to urge the pin 488 to reciprocate rearwardly. This rearward reciprocation is transferred through actuator rod 482 to urge the lever 514 into a position whereby the motor-enabling switch 486 is actuated. Once enabled, the motor 52 turns the cam 54 to induce the latch 456 to rotate into the latching position.

As shown, for example, in FIGS. 16–17, the latch 456 is mounted to the front mounting plate 529 for pivotal movement about the pivot axis extending through pivot pin 458 for movement between the latched position and an unlatched position. The latch 456 is coupled by the latch rod 462 to the cam 54. As the cam 54 rotates it first reaches a latched position and after additional rotation reaches a pulled-in position. This additional rotation of the cam 54 is transferred through the latch rod 462 to the latch 456 which pulls in against the oven door 26 to take up any mechanical slack from tolerance build up between the parts. While the latch 456 pulls in on the door 26 the seal 45 is compressed between the peripheral wall 46 of the door 26 and the forwardly facing wall 42 of the recessed region 40 adjacent the opening of the oven cavity 24.

As shown, for example, in FIGS. 18–21, the rear mounting bracket 531 includes a lower mounting plate 535 and an upper mounting plate 533. The lower mounting plate 535 includes a component mounting portion 545 and a mounting lip 543 extending downwardly from the front edge of the component mounting portion 545, as shown for example, in FIGS. 16, 18. The front surface of the mounting lip 543 is configured to engage the outer metallic wall 32 of the oven cavity back wall 25 and is formed to include mounting holes 586. Fasteners (not shown) extend through mounting holes 586 to mount the lower mounting plate 535 to the outer metallic wall 32 of the oven cavity back wall 25 so that the component mounting portion 545 extends rearwardly from the back wall 25 as shown, for example, in FIG. 16.

Upper mounting plate 533 includes a component mounting portion 592 and downwardly extending legs 588 configured to couple to lower mounting plate 535 to position component mounting portion 592 of the upper mounting plate 533 vertically above component mounting portion 545 of the lower mounting plate 535. Thus, components mounted to upper and lower mounting plates 533, 535 of the rear mounting bracket 531 are positioned well away from the high temperature region adjacent the opening of the oven cavity 24.

The rear mounting bracket 531 is rigidly mounted to the top of the rear of the rear wall 25 of the oven cavity 24, as shown, for example, in FIGS. 15–16. The motor and gear box 52 are mounted to the lower mounting plate 535 so that the shaft extends through a motor shaft-receiving hole 572 formed in the lower mounting plate 535. The cam 54 is mounted to the shaft so that the cam 54 turns as the motor 52 turns. When the oven door 26 is open, or when the door 26 is closed and a cleaning cycle has not been initiated, the cam 54 is positioned such that the latch rod 462 coupled thereto urges the latch 456 to rotate into the unlatched position so that the hook 457 does not interfere with the door 26 which is free to open or close.

When the door 26 closes, the door 12 engages the rounded end 490 of the plunger pin 488 and urges the plunger pin 488 rearwardly. The plunger pin 488 compresses the bias spring 484 which stores energy for providing a return force to urge plunger pin 488 and the lever 514 coupled thereto by the actuator rod 482 forwardly when the door 26 opens. Induced by the rearward movement of the plunger pin 488, the actuator rod 482 moves rearwardly inducing rotation of the lever 514 about the pivot axis extending through the lever pivot pin 515. During rotation, the follower surface 518 of the lever 514 actuates the motor-enabling switch 486.

After the contact button 528 is actuated by rotation of the switch actuator surface 518 of actuation lever 514, switch 486 sends a signal to the oven controller that permits current flow to the motor and gear box 52. Thus, movement of the plunger pin 488 by engagement with the oven door 26 during closure moves the lever 514 into a position to enable the motor and gear box 52 which may then move the cam 54 to a locking position upon receipt of a signal initiating a cleaning cycle.

The disclosed oven lock mechanism 430 not only moves the latch 456 into a latched position after a cleaning cycle initiation signal has been received, but it also moves the latch 456 into a snugging position in which the gasket or seal 45 disposed between the oven door 26 and the frame of the oven 12 is compressed as the door 26 is pulled into a more snug engagement with the frame. Rotation of the cam 54 causes the cam 54 to pull the latch rod 462 rearwardly causing the latch 456 to rotate so that the hook 457 of the latch 456 engages the inner wall of the rear wall 34 of oven door 26 and pulls the oven door 26 rearwardly causing the seal 45 to be compressed between the oven door 26 and the frame of the oven 12 in a well known manner.

After cam 54 rotates into the latched and pulled in position, the follower surface 55 of the cam previously actuating the contact button 475 of the cam-actuated switch 464 rotates to a position in which the contact button 475 is released. Upon release of the contact button 475, a timer circuit (not shown) is initiated and further rotation of the motor and gear box 52 and the cam 54 attached thereto is locked out until the timer expires indicating the end of the cleaning cycle.

At the end of the cleaning cycle, the cam 54 again rotates until it reaches the unlatched position. Thus, the cam 54 moves to a position in which the hook 457 of the latch 456 is no longer in engagement with the inner wall of the back wall 34 of the oven door 26. While the door 26 is no longer blocked from opening, the plunger pin 488 continues to engage the back wall of the oven door 26 and the oven door springs (not shown) overcome the attempts of the bias spring 484 to return the plunger pin 488 to the door open position. Only when the door 26 is pulled open and the door springs (not shown) are no longer forcing the oven door 26 against the plunger pin 488 does the bias spring 484 induce rotation of the actuator lever 514 to return to a position in which the contact 528 of the motor-enabling switch 486 is again actuated disabling the motor 52.

The manner of operation of the oven lock mechanism 430 can be better understood by understanding the configuration and interaction of the various components of the oven lock mechanism 430. These components are designed and configured to facilitate the above described manner of operation of the oven lock mechanism 430. As previously mentioned, the oven lock mechanism 430 includes a latch mechanism 450, a switch actuator mechanism 480, a front mounting plate 529 and a rear mounting bracket 531.

The latch 456 is configured to facilitate being rotated by the cam 54 into a latched position after closure of the oven door 26 enables the motor 52. As shown, for example, in FIG. 17, latch 456 includes a rod-receiving arm 453 and a latching arm 449 both extending generally radially from a central body 451 formed to include a pivot pin-mounting hole 465. Pivot mounting hole 465 is sized to receive the shaft of the pivot pin 458 therein. The latch 456 is substantially planar.

The latch 456 is configured to pivot about a pivot axis extending through the pivot pin 458. The latch 456 is mounted for pivotal movement relative to the front mounting plate 529. Generally, the latch 456 is mounted so that it is positioned below portions of the front mounting plate 529. During formation of the front mounting plate 529, certain bosses and riding surfaces (not shown) are formed on the front mounting plate 529 in a conventional manner to aid in reducing friction between the latch 456 and the front mounting plate 529 by reducing the surface area that is in engagement between the two. The bosses and riding surfaces also tend to aid in maintaining the substantially parallel relationship between the latch 456 and the component mounting portion 538 of the front mounting plate 529.

The rod-receiving arm 453 of the latch 456 extends laterally radially outwardly from the pivot pin-mounting hole 465. The rod-receiving arm 453 is formed to include a rod-mounting hole 461. The rod-mounting hole 461 is sized to receive the vertical section 472 of the latch end 468 of the latch rod 462 therein. The horizontal section 473 of the latch end 468 of the latch rod 462 prevents latch rod 462 from inadvertently detaching from the latch 456. As shown, for example, in FIG. 17, front mounting plate 529 includes a curved rear wall to permit latch rod 462 to be mounted in rod-mounting hole 461 without contacting mounting plate 529. Thus, rectilinear movement of the latch rod 462 induces the rod-receiving arm 453 to be urged to rotate about the pivot axis extending through pivot pin 458.

The latching arm 449 of the latch 456 extends radially from the pivot pin-mounting hole 465. In the illustrated embodiment, the latching arm 449 forms an angle with respect to the follower arm 458 of seventy-five degrees. When rectilinear movement of the latch rod 462 induces the rod-receiving arm 453 to rotate about the pivot axis extending through pivot pin 458, latch arm 449 is induced to rotate about the pivot axis extending through pivot pin 458. This rotation induces the latch 456 to move between the unlatched, latched and latched and pulled in positions.

Figure 18:
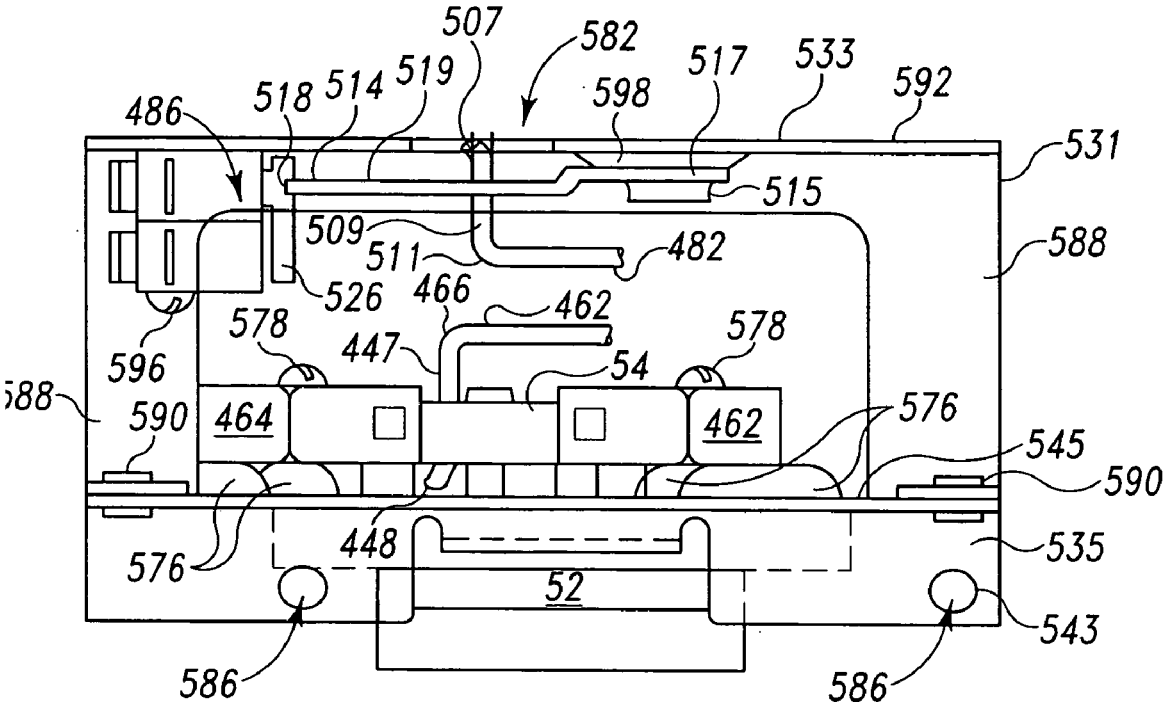
FIG. 18 is a front elevation view of the top and bottom mounting plates of the rear mounting bracket of the third embodiment of an oven lock assembly.
Figure 19:
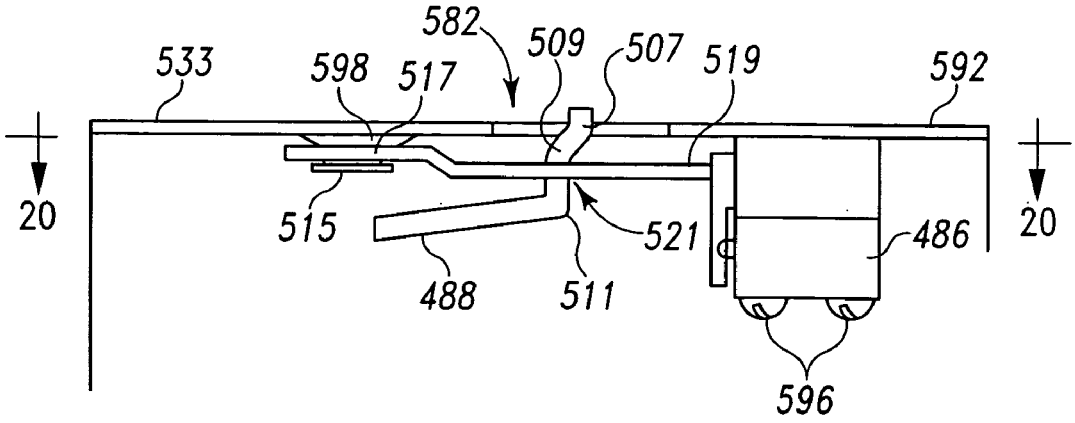
FIG. 19 is a rear elevation view of the top rear bracket, switch actuator, actuator rod and switch of the switch actuator mechanism of the third embodiment of the oven lock assembly.
Figure 20:
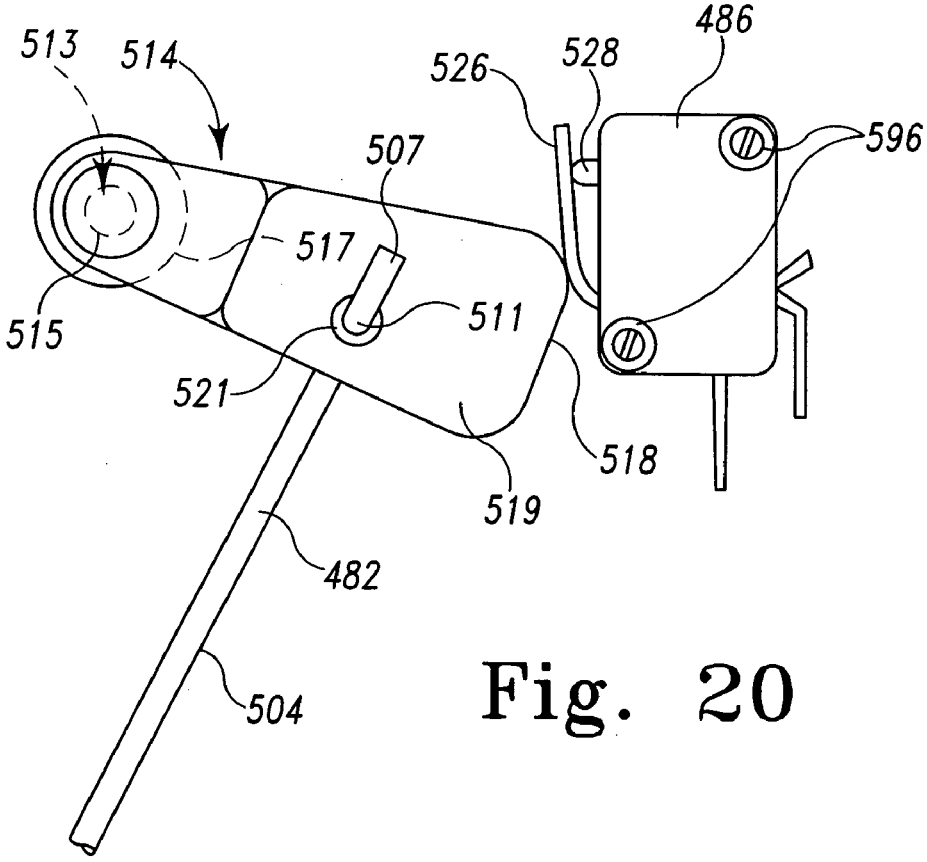
FIG. 20 is a view of the top rear bracket, switch actuator, actuator rod and switch of the switch actuator mechanism taken along line 20—20 of FIG. 19.

As shown, for example, in FIGS. 18–20, the actuator lever 514 is formed to include a mounting portion 517 and a switch actuator portion 519. Mounting portion 517 is formed to include a pivot pin-receiving hole 513 through which pivot pin 515 is received to pivotally mount actuator lever 514 to top mounting plate 533 of rear mounting bracket 531. As shown, for example, in FIGS. 18–19, switch actuator portion 519 is offset downwardly from, but remains substantially parallel to, mounting portion 517. The axis of switch actuator portion 519 extends radially from the pivot pin-receiving hole 513 formed in the mounting portion 517. The downward offset positions lever 514 appropriately to actuate switches 486 and to provide space for receipt of lever end 511 of actuator rod 482 through a rod-mounting hole 521. The rod-mounting hole 521 is formed in the switch actuator portion 519 centered on the axis with its focus displaced from the pivot pin-mounting hole 513 by a distance equal to the radius of curvature of the center of the rod-receiving slot 582 in the upper mounting plate 533 of the rear mounting bracket 531. When assembled, the upwardly extending rear arm 509 of lever end 511 of the actuator rod 482 extends through the push rod slot 582 in the upper mounting plate 533 of the rear mounting bracket 531 and is received in the push rod-receiving hole 521 of the lever 514, as shown, for example, in FIGS. 18–19.

The switch actuator or follower surface 518 on the outer end of the switch actuator portion 519 is curved with a radius of curvature centered at the focus (the location of pivot axis) of the pivot pin-mounting hole 513. The corners formed by the switch actuator surface 518 and the front and rear walls of the switch actuator portion 519 are radiused to facilitate smooth engagement and disengagement with the lever arm 526 engaging the contact 528 of the lever-actuated motor-enabling switches 486. Thus, so long as the switch actuator surface 518 remains in contact with the lever arm 526 of the lever-actuated motor-enabling switches 486 during rotation of the lever 514, the switch actuator surface 518 applies a constant force to the contact button 528. When the oven door 26 is closed the lever 462 is rotated sufficiently so that switch actuator surface 518 engages the lever arm 526 to depress the contact button 528 of the motor-enabling switch 486. In the illustrated embodiment, the lever actuated switch 486 is a normally open switch which is closed upon actuation of the contact 528 to close a circuit enabling the motor drive circuit or to send a signal to the oven controller to enable the drive circuit.

As explained earlier, motor 52 and cam 54 are used in each illustrated embodiment of the oven lock mechanism 30, 230, 430, 630. Thus the following description is applicable to all of the oven lock mechanisms.

Motor 52 is illustratively a synchronous induction AC high torque ODL class "F" motor. Motor and gear box 44 operate at 3 RPM in response to a 120 VAC, 60 Hz signal. Illustratively, motor has a 130 IN-OZ (0.92 Nm) minimum start and stall torque at 3 RPM over the operating range of 90V to 130V.

Figure 21:
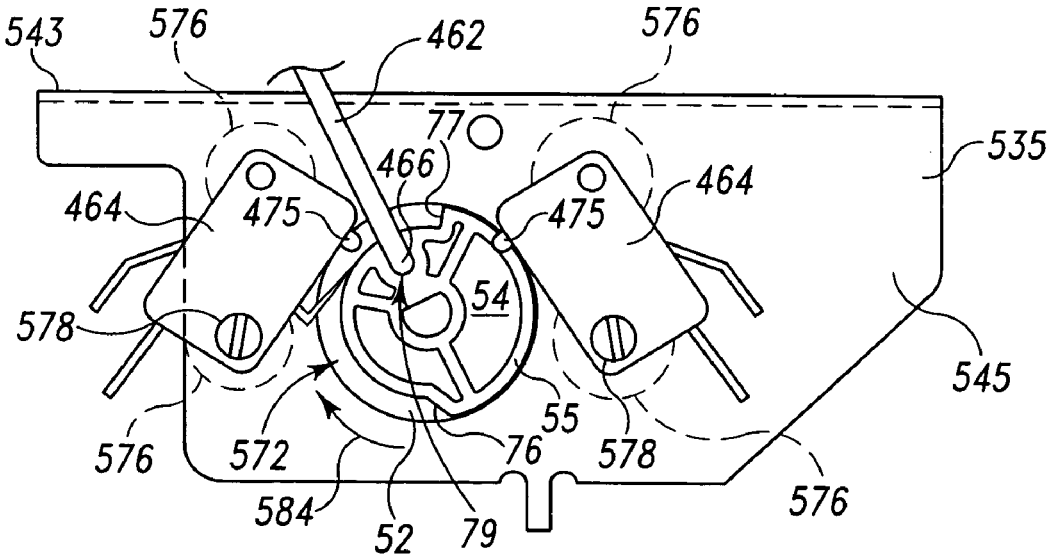
FIG. 21 is a top plan view of the bottom mounting plate of the rear mounting bracket of the third and fourth embodiments of the oven lock mechanism; and, FIG. 22 is a bottom plan view of the top mounting plate of the rear mounting bracket showing a linear actuator of the fourth embodiment of the oven lock mechanism.

As shown, for example, in FIG. 21, the cam 54 rotates in the direction of the arrow 584 which, from the perspective of FIG. 21, is clockwise. Therefore in describing components of the cam 54, the terms "leading" and "trailing" will be used to describe various components with the understanding that "leading" refers to a component that is clockwise with respect to the "trailing" component.

As shown, for example, in FIG. 21, the cam 54 includes a lobe. The lobe includes a leading side wall 76, a trailing side wall 77 and a follower surface 55. The follower surface 55 extends between the leading and the trailing side walls 76, 77. The follower surface 55 actuates switches 464. In the illustrated embodiment, follower surface 55 extends approximately 130 degrees peripherally around cam 54. Cam 54 includes a D-shaped shaft-mounting bore extending through a generally cylindrical body. The follower surface 55 is disposed radially outwardly from the generally cylindrical body and in the illustrated embodiment is formed integrally therewith. The D-shaped motor driven shaft is received in the D-shaped mounting bore to couple the cam 54 to the motor 52. Cam 54 is also formed to include a rod-receiving hole 79 through which the cam end 466 of latch rod 462 is received. The rod-receiving hole 79 is formed near the edge of the generally cylindrical body in a location leading the leading side wall 76 of the lobe, as shown, for example, in FIG. 21.

The leading side walls 76 and the trailing side walls 77 extend radially from the generally cylindrical body of cam 54. The leading side wall 76 and trailing side wall 77 form an angle of approximately one hundred thirty degrees with respect to each other. The follower surface 55 of the lobe is generally arcuate shaped having a radius of curvature centered at the mounting bore of the cam 54. However, at the junctures of the follower surface 55 with the leading side wall 76 and the trailing side wall 77, the follower surface 55 and the side walls 76, 77 are radiused. The radius at the junctures of the follower surface 55 and the side walls 76, 77 facilitates smooth engagement and disengagement of the follower surface 55 with the contact buttons 475 of the switches 464 during rotation of the cam 54.

As shown for example, in FIGS. 15–21, the latch push rod 462 includes a straight section, a cam end 466 and a latch end 468. The latch end includes a vertical section 472 and a horizontal section 473. The vertical section 472 extends through the rod-receiving hole 461 formed in latch 456 and the horizontal section 473 inhibits rod 482 from detaching from latch 456. The latch end 468 of latch rod 462 includes a downwardly extending arm 447, and a horizontal arm 448. The downwardly extending arm is received in the rod-receiving hole 79 of cam 54 and the horizontal arm inhibits rod 462 from detaching from cam 54 during rotation. The straight section spans the distance between the front mounting plate 529 and bottom mounting plate 535 of the rear mounting bracket 531. The length of the straight section is selected based upon the depth of the oven 12 and the lateral offset of the front mounting plate 529 and rear mounting bracket 531. The latch rod 462 couples the latch 456 and the cam 54 together so that movement of one component is transferred to the other.

As shown for example, in FIGS. 15–21, the actuator rod 482 includes a straight linkage portion 504 having a plunger end 505 and a lever end 511. Lever end 511 includes an upwardly extending arm 509 and an offset arm 507. Upwardly extending arm 509 of lever end 511 is received in rod-receiving hole 521 in lever and extends upwardly into arcuate slot 582 formed in upper mounting plate 533 of rear mounting bracket 531 as shown, for example, in FIGS. 18–19. Offset arm 507 inhibits actuator rod 482 from detaching from lever 514 during rotation.

The plunger end 505 of the actuator rod 482 includes a downwardly extending arm 503 and an offset arm 501. Downwardly extending arm 503 is received in rod-receiving hole 497 formed in plunger pin 488. The offset arm 501 inhibits actuator rod 482 from detaching from plunger 488 during reciprocal movement thereof. The straight linkage portion 504 spans the distance between the front mounting plate 529 and the upper mounting plate 533 of rear mounting bracket 531. The length of the straight linkage portion 504 is selected based upon the depth of the oven 12 and the lateral offset of the front mounting plate 529 and the rear mounting bracket 531. The actuator rod 482 couples the plunger pin 488 and the lever 514 together so that movement of one component is transferred to the other.

The illustrated mounting plates 130, 330, 529, 533, 535 are each stamped and formed from a single sheet of metal such as nickel electroplated bright nickel. Each mounting plate 529, 533, 535 includes essentially two regions, a substantially planar component mounting portion and an offset mounting portion.

The oven mounting portion of the front mounting plate 529 includes a downwardly extending lip 540. The lip 540 is coupled to and extends downwardly from the front edge of the component mounting portion 538. The downwardly extending lip 540 is formed to include two mounting holes, a plunger-mounting aperture 552 and a latch slot 550. Fasteners 551 extend through the two mounting holes to mount the front mounting plate 529 to the center portion of the front wall 19 of the oven frame 14. The shaft 494 of the plunger pin 488 is received in the shaft-receiving aperture 552 for reciprocal movement forwardly and rearwardly therein. The latching arm 449 of the latch 456 extends through slot 550 and rotates clockwise and counter-clockwise within the slot 550.

The component mounting portion 538 of the front mounting plate 529 is substantially planar. A flange 554 extends downwardly from the bottom surface of the front mounting plate 529 adjacent the plunger-receiving aperture 552 in the front lip 540. As shown, for example, in FIG. 17, plunger pin 488 is formed to include a slot 493 extending through its shaft 494. Guide flange 554 is formed to be received in the slot 493 and to guide the reciprocal movement of the plunger pin 488. In the illustrated embodiment, guide flange 554 also acts as an anchor point for one end of the bias spring 484. Bias spring 484 is coupled at the other end to a finger 489 extending from plunger pin 488. Bias spring 484 stores a restorative force during closure of the oven door 26 to return the plunger pin 488, the actuator rod 82 and the switch actuating lever 514 to their forward positions.

Front mounting plate 529 is also formed to include a mesa (not shown extending downwardly from the component mounting portion 538. A pivot pin-mounting hole 465 is formed through the center of the mesa and latch pivot pin 458 extends therethrough to mount latch 456 to front mounting plate 529.

The front mounting plate 529 is formed to facilitate mounting the plunger pin 488 thereto for reciprocal forward and rearward movement. When the plunger pin 488 is mounted to the front mounting plate 529, the shaft 494 of the plunger pin 488 is received in the shaft-receiving aperture 552. The guide flange 554 is received in the slot 493 in the shaft 494 of the plunger pin 488 to help guide the forward and rearward movement of the plunger pin 488.

The front mounting plate 529 is configured to facilitate mounting the latch 456 so that it can assume non-latching, latching and latching and pulled in positions. The latch 456 is mounted to pivot about a fixed pivot axis relative to the front mounting plate 529. When latch 456 is mounted to and supported pivotally below mounting plate 529, the bottom the main body 551 of the latch 456 rides on the mesa. Rotation of the latch 456 in either direction is limited by the latch arm 449 coming into engagement with an end wall of the rectangular latch opening 550.

As shown, for example, in FIG. 17, the rear and one side wall of the front mounting plate 529 are formed to permit the portions of the distal ends of the plunger pin 488 and the rod-receiving arm 453 containing the rod receiving holes 497, 461, respectively to extend beyond the mounting plate 529. This facilitates inserting the front end 505 of the actuator rod 482 into the rod-receiving hole 497 in the plunger pin 488 and the latch end 468 of the latch rod 462 into the rod-receiving hole 461 in the latch 456 without encountering interference from the mounting plate 529.

The oven mounting portion of the bottom mounting plate 535 of the rear mounting bracket includes a downwardly extending lip 543. The lip 543 is coupled to and extends downwardly from the front edge of the component mounting portion 545. The downwardly extending lip 543 is formed to include two mounting holes 586, as shown, for example, in FIG. 18. Fasteners (not shown) extend through the two mounting holes 586 to mount the bottom mounting plate 535 of rear mounting bracket 531 to the outer metallic wall 32 of the rear wall 25 of oven cavity 24.

The component mounting portion 545 of the bottom mounting plate 535 of the rear mounting bracket 531 is configured to facilitate mounting the motor and gearbox 52 and the cam 54 in a fixed position relative to the bottom mounting plate 535. The motor and gearbox 52 and the cam 54 are mounted in a position so that the follower surface 55 of the cam 54 interacts with the contact buttons 475 of the cam-actuated switches 464. Thus, the bottom mounting plate 535 includes a cam-receiving aperture 572 sized to permit the motor driven shaft and the generally cylindrical body of the cam 54 to extend therethrough and rotate therein without engaging the walls of the hole 572.

Switch mount bosses 576 extend upwardly from the top surface of the bottom mounting plate 535 of the rear mounting bracket 531 to position switches 464 vertically to interact with cam 54, as shown, for example, in FIG. 18. Mounting holes (not shown) extend through the flat surfaces of two of the mount bosses 576 through which fasteners 578 extend to mount switches 464 to the top and motor 52 to the bottom of bottom mounting plate 535 of the rear mounting bracket 531. When the fasteners 578 extend through the mounting holes, the motor driven shaft is disposed in the center of the cam-receiving hole 572. The cam 54 is mounted on the motor driven shaft to interact with the contacts 475 of switches 464. The mounting holes and mounting bosses 576 are positioned and configured to place the contact buttons 475 of the cam-actuated switches 464 where they can be actuated by the lobe of the cam 54 during rotation of the cam 54.

The mounting portion of the top mounting plate 533 of the rear mounting bracket 531 includes downwardly extending legs 588 configured at the bottom thereof to receive fasteners 590 therethrough to couple top mounting plate 533 to bottom mounting plate 535. The legs 588 are coupled to and extend downwardly from the component mounting portion 592, as shown, for example, in FIGS. 16, 18.

The component mounting portion 592 of the top mounting plate 533 of the rear mounting bracket 531 is formed to facilitate actuation of the lever actuated switches 486 by the actuator surface 518 of the lever 514. The actuator surface 518 selectively engages and disengages the lever arm 526 that actuates the contact button 528 of the lever-actuated switches 486. Two mounting holes (not shown) are formed in component mounting portion 592 for mounting switches 486 to the bottom surface of the mounting plate 533. Fasteners 596 extend through the mounting holes and mounting holes (obscured by fasteners 596) on the switches 486 to mount the switches 486 to the mounting plate 533.

The mounting plate 533 is formed to include an arcuate slot 582 through which the rear upwardly extending arm 509 of the lever end 511 of actuator rod 482 extends after being received through the push rod-receiving hole 521 of the lever 514. The arcuate slot 582 is sufficiently wide to receive the upwardly extending arm 509 of the actuator rod 482 therethrough without the actuator rod 482 engaging the walls of the slot 582. The walls of the slot 582 are formed concentrically about an arc having a radius of curvature equal to the distance between the centers of the pivot pin-mounting hole 513 and the rod-receiving hole 521 in the lever 514.

Mounting plate 533 is formed to include a downwardly extending frusto-conical mount boss 598 for mounting lever 514 at the appropriate vertical position to interact with the lever arm 526 actuating the contact buttons 528 of the motor-enabling switch 486, as shown, for example, in FIGS. 18–19. Pivot pin-mounting hole 513 is formed in the center of the flat bottom surface of the mounting boss 598. Lever pivot pin 515 extends through mounting hole 513 to mount lever 514 to the top mounting plate 533 of the rear mounting bracket 531.

Figure 22:
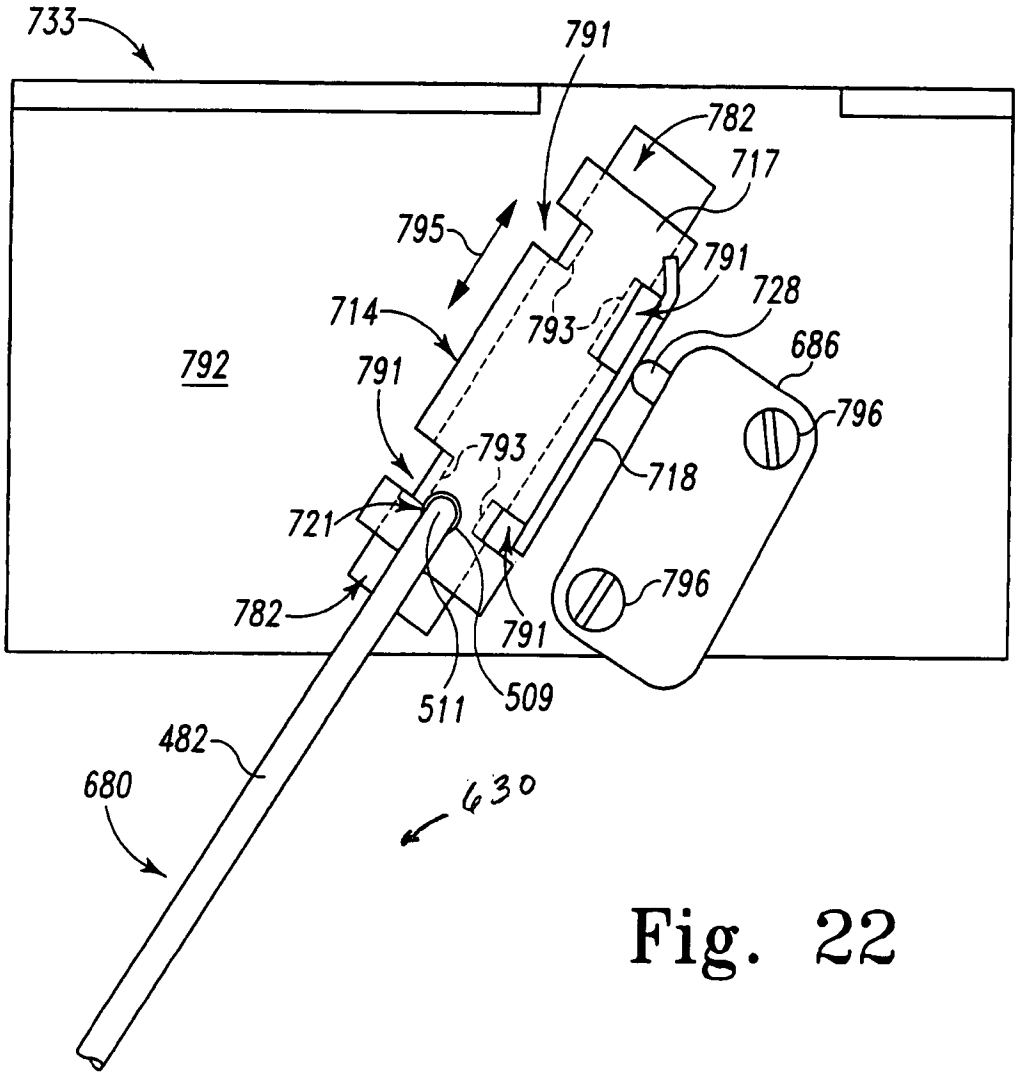

The fourth illustrated embodiment of the oven lock mechanism 630 is identical to the third illustrated embodiment 430 except that a linear switch actuator 714 is mounted to the top mounting plate 733 of the rear mounting bracket to actuate the motor-enabling switches 686 mounted thereto. Since oven lock mechanism 630 is so similar to oven lock mechanism 430, only the top mounting plate 733 of the rear mounting bracket is illustrated in FIG. 22. Those skilled in the art will recognize that the description of oven lock mechanism 430 applies to oven lock mechanism 630. Because of the similarity between components, similar reference numerals will be used to describe similar components and identical reference numerals will be used to describe identical components. Where components are identical the reference numerals used in describing the component with reference to the oven lock mechanism 430 will be used in describing oven lock mechanism 630.

As shown, for example, in FIG. 22, the linear actuator 714 is mounted to the top mounting plate 733 for movement with respect to the in the top mounting plate 733. The linear actuator 714 is mounted for reciprocal movement in the direction of the arrow 795 in response to reciprocal movement of the actuator rod 482. Illustratively, the linear actuator 714 is formed from a cut and shaped sheet of metal material. The linear actuator 714 includes a flat body plate 717 and an actuator arm 718 extending downwardly from the bottom surface of the flat body plate 717. The actuator arm 718 selectively engages and depresses contact 728 of motor-enabling switch 686 during forward and rearward movement of the linear actuator 714. Near the rear end, actuator arm 718 is curved as shown in FIG. 22 to facilitate smooth engagement of the arm 718 with the contact button 728. Illustratively, two notches 791 are formed along both sides of body plate 717. Each notch 791 is formed by cutting the material forming the body plate in two locations perpendicular to the sides and bending the material between the cuts upwardly to form guide tabs 793. The guide tabs 793 extend into and engage the side walls of the slot 782 to guide the reciprocal movement of the linear actuator 714. Near the front end, linear actuator 714 is formed to include a rod-receiving hole 721.

The component mounting portion 792 of the top mounting plate 733 of the rear mounting bracket 531 is formed to facilitate actuation of the motor-enabling switches 686 by the actuator arm 718 of the linear actuator 714. The cantilevered actuator arm 718 selectively engages and disengages the contact button 728 of the motor-enabling 686 during reciprocal movement in the direction of arrow 795.

Two mounting holes (not shown) are formed in component mounting portion 792 for mounting switches 686 to the bottom surface of the mounting plate 733. Fasteners 796 extend through the mounting holes and mounting holes (obscured by fasteners 796) on the switches 686 to mount the switches 686 to the mounting plate 733.

The mounting plate 733 is formed to include a straight slot 782 through which the rear upwardly extending arm 509 of the end 511 of actuator rod 482 extends after being received through the push rod-receiving hole 721 of the linear actuator 714. The straight slot 782 is sufficiently wide to receive the upwardly extending arm 509 of the actuator rod 482 therethrough without the actuator rod 482 engaging the walls of the slot 782. The walls of the slot 782 act as surfaces against which guide tabs 793 ride to guide movement of the linear actuator 714.

The oven lock mechanisms 30, 230, 430, 630 disclosed herein utilize door closure to actuate a motor-enabling switch 82, 482, 682. Once enabled the motor 52 rotates to place the latch 56, 456 first in a latched position and then in a latched and pulled-in position when a self-cleaning cycle is initiated. Any attempt to open the oven door 26 is unsuccessful during the cleaning cycle since the latch 56, 456 blocks the door 26 from opening. At the end of the self-cleaning cycle, a signal is sent to the motor 52 which rotates to move the latch 56, 456 to an unlatched position. The oven door 26 can then be opened.

While both oven lock mechanisms 30, 230 disclosed herein use the motor and gearbox 52 and a cam 54 to move the latch 56, 456 once it is in the latched position to a latched and pulled-in position, it is within the scope of the disclosure for the motor and gearbox 52 to actuate movement of the cam 54 to move the latch to a latched position without inducing additional movement of the latch 56, 456 to cause pull-in. In each illustrated embodiment of oven door lock mechanism 30, 230, 430, 630 temperature sensitive electrical components are located away from the high temperature area adjacent the opening of the oven compartment 24. It is within the scope of the disclosure to position less than all of the heat sensitive components outside the high temperature area.

Latch mechanism and actuators for switches are mounted in a location on the oven frame where they can interact with the oven door 26 even if the door 26 is bent or warped. In each of the illustrated embodiments, the hook portion 57, 457 of the latch 56, 456 of the latch mechanism 50, 450 and the rounded end 90, 490 of the plunger 88, 488 of the switch actuator mechanism 80, 280, 480, 680 extend forwardly beyond the center portion of the front wall 19 of the frame of the oven above the opening of the oven compartment 24. This central location places both mechanisms where they will engage the center of the oven door 26 when it is closed. The center of the top of the oven door 26 is not as likely to be adversely affected by door warpage or bending as the sides of the top of the oven door 26 when the oven door is hinged to rotate about a horizontal axis adjacent the bottom of the oven door 26. It is within the scope of the disclosure for the switch actuator mechanism 80, 280, 480, 680 to be positioned to engage the oven door 26 in some other location that is not adversely affected by door warpage or bending. It is within the scope of the disclosure for the latch mechanism to be positioned to engage the oven door 26 in some other location that is not adversely affected by door warpage or bending.

The positioning of the latch mechanism adjacent to the switch actuator mechanism is advantageous because, if the switch actuator mechanism is forced to actuate the switch due to engagement with the oven door, the latch mechanism is likely to capture the oven door during rotation from the unlatched to the latched position. However, it is within the scope of the disclosure for the switch actuation and latch mechanisms to be mounted in locations not adjacent each other.

Although the invention has been described in detail with reference to a certain preferred embodiment, variations and modifications exist within the scope and spirit of the present invention as described and defined in the following claims.

What is claimed is:

1. An oven locking mechanism for a self-cleaning oven having an oven compartment having an opening defined by a top frame wall, a bottom frame wall and side frame walls, an oven door having a top wall, a bottom wall and side walls configured to close the oven compartment, the top walls of the oven frame and the oven door having a central region displaced from the side walls, the oven locking mechanism comprising:

a mounting plate located above the oven compartment;

a latch mounted to the mounting plate so the latch extends forwardly beyond the central region of the top wall of the oven frame to engage a portion of the door located in the central region when moved into a latched position;

an electromechanical actuator coupled to the latch for moving the latch to the latched position when actuated;

a switch electrically coupled to the electromechanical actuator and configured to enable the electromechanical actuator when in a first state and disable the electromechanical actuator when in a second state, said switch being mounted to the oven away from the oven compartment opening;

a plunger mounted on the mounting plate in the central region of the top wall of the frame for movement relative to the frame, the plunger having a door engaging end and a switch engaging end, the switch engaging end being laterally offset from the switch and a laterally extending switch actuator of the switch engaging end being proximate the switch, when the plunger is in a first position the door engaging end extends forward beyond the frame of the oven in a position to be engaged by a portion of the door in the central region of the top wall during closure of the oven door;

a stop between the door engaging end and the switch engaging end;

a spring seat positioned about the plunger between the stop and the switch engaging end;

a spring positioned about the plunger between the spring seat and the switch engaging end, the spring at one end being operatively supported by a portion of the mounting plate and contacting the spring seat at another end, and arranged so the spring is selectively compressed by the spring seat as the door engaging end of the plunger is pushed by the portion of the door during closure of the oven door and the spring seat is stopped by the stop as the seat is pushed by restorative force stored during compression of the spring; and the switch actuator of the switch engaging end laterally engaging the switch to change the state of the switch between the first and second states in response to the position of the switch engaging end of the plunger.

2. The device of claim 1 wherein the oven has a high temperature region adjacent the oven opening and lower temperature regions displaced from the oven opening and the switch is mounted in a lower temperature region.

3. The device of claim 2 wherein the electromechanical actuator is mounted in a lower temperature region.

4. The device of claim 2 wherein the laterally extending switch actuator is a C-shaped bend in the plunger.

5. The device of claim 4 wherein the plunger reciprocates forwardly and rearwardly.

6. The device of claim 5 wherein the switch actuator reciprocates forwardly and rearwardly in a region proximate the switch, the reciprocation of the switch actuator being controlled by the interaction of the spring with the spring seat step.

7. The device of claim 6 wherein the plunger and the switch actuator are monolithic.

8. The device of claim 4 wherein the electromechanical actuator is mounted in a lower temperature region.

9. The device of claim 8, the portion of the mounting plate operatively supporting one end of the spring further comprising:

a rear guide flange extending from the mounting plate to which one end of the spring is mounted.

10. The device of claim 9 wherein the electromechanical actuator comprises a motor.

11. The device of claim 10 wherein the plunger and the switch actuator are monolithic.

12. An oven lock mechanism for a self-cleaning oven having a front, a rear and a front opening oven compartment and an oven door configured to close the oven compartment, the lock mechanism comprising:

a latch mechanism for latching the door by engaging a portion of the door, said latch mechanism including:

a latch mounted for movement relative to the oven frame between a first position in which the oven door opens and closes freely without being inhibited by the latch and a second position in which the latch inhibits opening a closed oven door;

an electromechanical actuator coupled to the latch for moving the latch between the first and the second positions;

drive circuitry configured to selectively drive the electromechanical actuator;

a switch electrically coupled to the drive circuitry and configured to enable the drive circuitry when in a first state and disable the drive circuitry when in a second state, said switch being mounted to the oven at the rear of the oven;

a switch actuator mechanism comprising:

a plunger mounted over the oven compartment for movement relative to the oven compartment, the plunger having a door engaging end which when the plunger is in a first position extends forward beyond the frame of the oven in a position to be engaged by a portion of the oven door during closure of the oven door and a switch actuating end that is laterally offset from the switch;

a stop located on the plunger between the door engaging end and the switch actuating end;

a spring seat positioned about the plunger between the stop and the switch actuating end;

a spring positioned about the plunger between the spring seat and the spring actuating end, the spring at one end being operatively supported by a portion of the mounting plate and contacting the spring seat at another end, and arranged so the spring is selectively compressed by the spring seat as the door engaging end of the plunger is pushed by the portion of the door during closure of the oven door and the spring seat is stopped by the stop as the seat is pushed by restorative force stored during compression of the spring; and a laterally extending switch actuator coupled to the plunger that is configured to change the state of the switch between the first and second states based on the position of the plunger.

13. The device of claim 12 wherein the laterally extending switch actuator is a C-shaped bend in the plunger.

14. The device of claim 13 wherein the electromechanical actuator is a motor that is mounted to the oven at the rear of the oven.

15. The device of claim 12 wherein the plunger is a rod extending from the front of the oven to a position proximate the rear of the oven and the C-shaped bend is a bend in the rod.

16. An oven lock mechanism for an oven having a front opening oven compartment having a back wall and side walls, a top frame wall disposed above the oven compartment and having a central portion displaced from the side walls and a door configured to close the oven compartment by pivoting from an open to a closed position, the lock mechanism comprising:

a front mounting plate portion mounted to the center portion of the top frame wall;

a rear mounting plate portion mounted to the back wall of the oven compartment;

a latch pivotally mounted to the front mounting plate and comprising a latch hook extending forwardly beyond the top frame wall, the latch being configured to pivot between a latched position wherein the latch hook engages and inhibits pivotal movement of the door and an unlatched position wherein the latch does not inhibit pivotal movement of the door;

a motor coupled to the latch to move the same between the latched and unlatched positions when driven;

a switch configured to enable the motor to be driven when in a first state and disable the motor from being driven when in a second state, the switch being mounted to the rear mounting plate portion; and a switch actuating mechanism laterally offset from the switch, the switch actuating mechanism including an engagement portion mounted for movement relative to the front mounting plate portion and configured to engage and be moved by the door during pivotal movement of the door and an actuator portion coupled to the engagement portion and configured with a laterally extending portion to change the state of the switch from the second state to the first state in response to movement of the engagement portion;

a stop located between the engagement portion and the actuator portion;

a spring seat positioned between the stop and the actuator portion;

a spring between the spring seat and the actuator portion, the spring at one end being operatively supported by a portion of the mounting plate and contacting the spring seat at another end, and arranged so the spring is selectively compressed by the spring seat as the engagement portion is pushed by the door during closure of the oven door and the spring seat is stopped by the stop as the seat is pushed by restorative force stored during compression of the spring; and the laterally extending portion changes the state of the switch in response to movement of the engagement portion.

17. The device of claim 16 wherein the front mounting plate portion and rear mounting plate portion are part of a monolithic mounting plate.

18. The device of claim 16 wherein the engagement portion and the actuator portion are formed from a monolithic actuator rod.

19. The device of claim 18 wherein the laterally extending portion is a C-shaped bend in the monolithic actuator rod.

20. The device of claim 19 wherein the engagement portion engages a central portion of the top of the oven door during closure of the door.

* * * * *